US008171742B2

(12) United States Patent
Caughley et al.

(10) Patent No.: US 8,171,742 B2
(45) Date of Patent: May 8, 2012

(54) PRESSURE WAVE GENERATOR

(75) Inventors: Alan James Caughley, Christchurch (NZ); David Haywood, Christchurch (NZ)

(73) Assignee: Industrial Research Limited, Lower Hutt (NZ)

( * ) Notice: Subject to any disclaimer, the term of this patent is extended or adjusted under 35 U.S.C. 154(b) by 909 days.

(21) Appl. No.: 11/912,218

(22) PCT Filed: Apr. 21, 2006

(86) PCT No.: PCT/NZ2006/000082

§ 371 (c)(1), (2), (4) Date: Jun. 23, 2008

(87) PCT Pub. No.: WO2006/112741

PCT Pub. Date: Oct. 26, 2006

(65) Prior Publication Data

US 2008/0253910 A1 Oct. 16, 2008

(30) Foreign Application Priority Data

Apr. 21, 2005 (NZ) ..... 539604
Jan. 17, 2006 (NZ) ..... 544776

(51) Int. Cl.

| | |
|---|---|
| ***F25B 9/00*** | (2006.01) |
| ***F04B 23/04*** | (2006.01) |
| ***F04B 41/06*** | (2006.01) |
| ***F04B 39/10*** | (2006.01) |
| ***F04B 53/10*** | (2006.01) |
| ***F01B 21/02*** | (2006.01) |
| ***F01B 7/02*** | (2006.01) |

(52) U.S. Cl. ..... 62/6; 417/521; 417/534; 92/64; 92/75

(58) Field of Classification Search ..... 417/521, 417/534, 265, 266; 92/64, 68, 75, 76; 62/6
See application file for complete search history.

(56) References Cited

U.S. PATENT DOCUMENTS 2,657,528 A 11/1953 Jonkers
3,552,120 A 1/1971 Beale
(Continued)

FOREIGN PATENT DOCUMENTS

BE 1007437 A3 6/1995
(Continued)

OTHER PUBLICATIONS

Supplementary Euopean Search Report dated Nov. 3, 2010 of EP Application 06 73 3171, pp. 1-2, Annex, and sheets 1-5.

*Primary Examiner* — Frantz Jules
*Assistant Examiner* — Daniel C Comings
(74) *Attorney, Agent, or Firm* — Dann, Dorfman, Herrell and Skillman, P.C.

(57) ABSTRACT

A pressure wave generator (40) for driving one or more cryogenic refrigerator systems. The pressure wave generator (40) comprises a housing with one or more inlet/outlet ports (57, 58) through which generated pressure waves of gas may pass through to drive a cryogenic refrigerator system or systems connected to the inlet/outlet ports (57,58). The pressure waves are generated by at least on pair of opposed diaphragms (41,42) located in the housing that are moveable in a reciprocating motion within the housing to create pressure waves in gas spaces (55,56) associated with each diaphragm (41,42). The gas spaces (55,56) each having associated inlet/outlet ports (57,58) through which the pressure waves may pass. An operable drive system is also provided to move the pair of diaphragms (41,42) in a reciprocating motion.

18 Claims, 14 Drawing Sheets

U.S. PATENT DOCUMENTS

| | | | | | |
|---|---|---|---|---|---|
| 3,684,406 | A | | 8/1972 | Edwards | |
| 3,823,710 | A | | 7/1974 | Borden | |
| 4,019,335 | A | | 4/1977 | Browning | |
| 4,314,447 | A | | 2/1982 | Gray | |
| 4,383,586 | A | | 5/1983 | Lee | |
| 4,702,419 | A | | 10/1987 | Luchsinger | |
| 4,703,622 | A | | 11/1987 | Raser | |
| 4,983,876 | A | | 1/1991 | Nakamura et al. | |
| 5,088,284 | A | | 2/1992 | Momose | |
| 5,171,129 | A | * | 12/1992 | Vincent | 417/18 |
| 5,293,748 | A | | 3/1994 | Flanigan | |
| 5,295,791 | A | | 3/1994 | Meise | |
| 5,534,896 | A | | 7/1996 | Osborne | |
| 5,649,809 | A | * | 7/1997 | Stapelfeldt | 417/63 |
| 2004/0197201 | A1 | | 10/2004 | Moisidis | |
| 2006/0180018 | A1 | * | 8/2006 | Kabir et al. | 92/140 |

FOREIGN PATENT DOCUMENTS

| | | | |
|---|---|---|---|
| EP | 0743452 | A1 | 11/1996 |
| GB | 514815 | | 11/1939 |
| GB | 1038576 | | 8/1966 |
| GB | 1221993 | | 2/1971 |
| GB | 2273975 | | 7/1994 |
| JP | 8-14684 | | 1/1996 |
| JP | 09-296965 | | 11/1997 |

* cited by examiner

PRESSURE WAVE GENERATOR

FIELD OF THE INVENTION

The present invention relates to a pressure wave generator. In particular, although not exclusively, the pressure wave generator may be utilised in cryogenic refrigerator systems.

BACKGROUND TO THE INVENTION

Many cryogenic refrigerators, such as Stirling refrigerators and pulse tubes, are driven by a reciprocating pressure wave. To generate the waves, state of the art practice employs clearance gap pistons driven by linear motors, which are both efficient but costly technologies.

A Stirling refrigerator achieves cooling by compressing the working gas in a compression space where heat is rejected, moving the compressed gas through a regenerator which cools it down, expanding the gas in an expansion space where heat is absorbed and finally moving the gas back through the regenerator to the compression space, the regenerator warming it up again. The Stirling machine typically has the expansion lagging compression by 90 degrees in the cycle. Typically Stirling refrigerators use two pistons, either positively driven or in a resonant condition 90 degrees out of phase.

Referring to FIG. 1, pulse tube refrigerators 10 can run the same gas cycle using a pressure wave generator 11, regenerator 12, and plug of gas in the pulse tube 13 as a virtual expansion piston thus eliminating moving parts in the cold part of the machine. An orifice or inertance tube 15 and reservoir 16 are used to achieve the required phase shift. The pulse tube also has a heat pumping effect so heat is rejected at 14 and a large temperature gradient along the pulse tube's length can be maintained. Heat exchanger 17 removes the heat of compression and heat exchanger 18 absorbs heat at the cold temperature.

It is an object of the present invention to provide an improved pressure wave generator for driving cryogenic refrigerator systems, or to at least provide the public with a useful choice.

SUMMARY OF THE INVENTION

In a first aspect, the present invention broadly consists in a pressure wave generator for driving one or more cryogenic refrigerator systems, comprising: a housing with one or more inlet/outlet ports through which generated pressure waves of gas may pass through to drive a cryogenic refrigerator system or systems connected to the inlet/outlet port(s); at least one pair of opposed diaphragms located in the housing that are moveable in a reciprocating motion within the housing to create pressure waves in gas spaces associated with each diaphragm, at least one of the gas spaces having an associated inlet/outlet port through which the pressure waves may pass, the gas spaces associated with each pair of diaphragms being connected to balance the average gas forces on the diaphragms; and a drive system that is operable to move each pair of diaphragms in a reciprocating motion within the housing to generate the pressure waves for driving one or more cryogenic refrigerator systems connected to the inlet/outlet port(s) of the housing.

Preferably, the drive system is arranged to move each pair of diaphragms so that there is a phase difference between the pressure waves generated by each diaphragm in each gas space Preferably, the diaphragms of each pair are operatively coupled such that they are moved together by the drive system in a reciprocating motion so that the pressure waves generated by one diaphragm of the pair are 180 degrees out of phase with the pressure waves generated by the other diaphragm of the pair.

Preferably, there are two pairs of opposed diaphragms located in the housing, the pairs being substantially orthogonal to each other such that the pressure waves generated by the diaphragms of one pair are 90° out of phase with those generated by the diaphragms of the other pair.

Preferably, the drive system comprises reciprocating pistons that are coupled to the diaphragms and one or more operable actuators that are arranged to drive the pistons in a reciprocating motion. More preferably, the drive system comprises a reciprocating piston for each pair of diaphragms, each piston being coupled to a pair of the diaphragms and being driven in a reciprocating motion by one or more operable actuators.

Preferably, the pairs of diaphragms are annular, with the inner edges of each pair of diaphragms being fixed to opposed ends of a respective piston and the outer edges being fixed at opposing locations within the housing.

In one form, the actuator(s) of the drive system are directly coupled to the piston(s) of the drive system. Preferably, the actuator of the drive system comprises a single rotatable crank shaft that has a crank for each piston, each piston being coupled to a respective crank of the crank shaft via a conrod, such that when the crank shaft rotates it causes the conrods to move in a reciprocating motion thereby driving the pistons in a reciprocating motion. More preferably, there are two pairs of opposed diaphragms located in the housing, the pairs being substantially orthogonal to each other, and the crank of the crank shaft for one pair of diaphragms leads the other crank of the crank shaft for the other pair of diaphragms by 90 degrees.

In another form, the actuator(s) of the drive system are indirectly coupled to the piston(s) of the drive system via a pivotable lever or levers. Preferably, each piston of the drive system is coupled to a pivotable lever, and an actuator is coupled to an end of the lever and is arranged to pivot the lever in a reciprocating arc about its pivot point to thereby drive the piston and its pair of diaphragms in a reciprocating motion to generate pressure waves.

In one form, each lever is fixed at one end to one or more flexible linkages mounted within the housing that are arranged to create a pivot point at the end of the lever about which the lever may pivot. Preferably, the flexible linkages flex in response to force applied to the free end of the lever thereby allowing the lever to pivot about the pivot point. More preferably, each lever is coupled to a piston via one or more flexible linkages that extend between a part of the lever and a part of the piston.

In another form, the lever is coupled at one end to a mounting component fixed within the housing via a pivotable coupling about which the lever may pivot. Preferably, each lever is coupled to a piston via a rigid linkage that extends between a part of the lever and a part of the piston.

Preferably, the actuator comprises a conrod that is coupled between an end of the lever and a crank of a rotatable crank shaft such that when the crank shaft rotates it causes the conrod to move in a reciprocating motion thereby driving the end of the lever in a reciprocating arc.

Preferably, the actuator(s) of the drive system are not located in the gas spaces of the housing.

Preferably, each gas space is defined by a diaphragm, a surface of the associated piston of the drive system for the diaphragm, and part of the housing. More preferably, the components that define the gas space are formed from material that is suitable for heat exchanging.

Preferably, the gas spaces associated with each pair of diaphragms are connected by a connection pipe, the connection pipe comprising an orifice to reduce gas flow between the two gas spaces to negligible levels.

Preferably, each inlet/outlet port has an associated valve that is operable to restrict flow directionally as desired.

Preferably, the diaphragms of each pair are operatively coupled together so that they move together to balance the average gas forces on the diaphragms.

Preferably, the inlet/outlet port(s) are connected to any one or more of the following cryogenic refrigerator systems: Stirling, pulse tube, and/or Gifford McMahon systems.

In a second aspect, the present invention broadly consists in a pressure wave generator for driving one or more cryogenic refrigerator systems, comprising: a housing with one or more inlet/outlet ports through which generated pressure waves of gas may pass through to drive a cryogenic refrigerator system or systems connected to the inlet/outlet port(s); at least one pair of opposed diaphragms located in the housing that are moveable in a reciprocating motion within the housing to create pressure waves in gas spaces associated with each diaphragm, at least one gas space having an associated inlet/outlet port through which the pressure waves may pass, the diaphragms of each pair being operatively coupled together so that they move together; and a drive system that is operable to move each pair of diaphragms in a reciprocating motion within the housing to generate pressure waves for driving one or more cryogenic refrigerator systems connected to the inlet/outlet port(s) of the housing.

Preferably, the drive system is arranged to move each pair of diaphragms so that there is a phase difference between the pressure waves generated by each diaphragm in each gas space.

Preferably, the drive system comprises a reciprocating piston for each pair of diaphragms, each piston being coupled to a pair of the diaphragms and being driven in a reciprocating motion by one or more operable actuators. More preferably, the pair(s) of diaphragms are annular, with the inner edges of each pair of diaphragms being fixed to opposed ends of a respective piston and the outer edges being fixed at opposing locations within the housing.

In one form, the actuator(s) of the drive system are directly coupled to the piston(s) of the drive system.

Preferably, the actuator of the drive system comprises a single rotatable crank shaft that has a crank for each piston, each piston being coupled to a respective crank of the crank shaft via a conrod, such that when the crank shaft rotates it causes the conrods to move in a reciprocating motion thereby driving the pistons in a reciprocating motion.

In another form, the actuator(s) of the drive system are indirectly coupled to the piston(s) of the drive system via a pivotable lever or levers.

Preferably, each piston of the drive system is coupled to a pivotable lever, and an actuator is coupled to an end of the lever and is arranged to pivot the lever in a reciprocating arc about its pivot point to thereby drive the piston and its pair of diaphragms in a reciprocating motion to generate pressure waves.

In one form, each lever is fixed at one end to one or more flexible linkages mounted within the housing that are arranged to create a pivot point at the end of the lever about which the lever may pivot, the flexible linkages being arranged to flex in response to force applied to the end of the lever thereby allowing the lever to pivot about the pivot point. In another form, each lever is coupled at one end to a mounting component fixed within the housing via a pivotable coupling about which the lever may pivot.

Preferably, the actuator comprises a conrod that is coupled between an end of the lever and a crank of a rotatable crank shaft such that when the crank shaft rotates it causes the conrod to move in a reciprocating motion thereby driving the end of the lever in a reciprocating arc.

Preferably, the actuator(s) of the drive system are not located in the gas spaces of the housing.

Preferably, the gas spaces associated with each pair of diaphragms are connected by a connection pipe, the connection pipe comprising an orifice to control and gas flow between the two gas spaces.

Preferably, the inlet/outlet port(s) are connected to any on or more of the following cryogenic refrigerator systems: Stirling, pulse tube, and/or Gifford McMahon systems.

In a third aspect, the present invention broadly consists in a pressure wave generator for driving one or more cryogenic refrigerator systems, comprising: a housing with one or more inlet/outlet ports through which generated pressure waves may pass; one or more diaphragms located in the housing that are arranged to move in a reciprocating motion to generate pressure waves; and an operable drive system that is arranged to manipulate the diaphragm(s) in a reciprocating motion within the housing to generate pressure waves to drive one or more cryogenic refrigerator systems connected to the inlet/outlet ports of the housing.

Preferably, there is at least one pair of opposed diaphragms located in the housing, the diaphragms being operatively coupled together so that they move together.

Preferably, the drive system is arranged to move each pair of diaphragms such that there is a phase difference between the pressure waves created by each diaphragm.

Preferably, each diaphragm is arranged to cooperate with and move within an associated gas space having a volume of gas to generate pressure waves in the gas space.

Preferably, there is at least one pair of opposed diaphragms located in the housing, the diaphragms being operatively coupled together so that they move together, and the gas spaces associated with each diaphragm of the pair being connected to balance the average gas forces on the diaphragms of the pair.

In a fourth aspect, the present invention broadly consists in a cryogenic refrigerator system that is driven by any one of the aspects of the pressure wave generator of the invention defined above.

The phrase "gas space" as used in this specification and the accompanying claims is intended to cover either a compression or expansion space having a volume of operating gas.

The term 'comprising' as used in this specification and claims means 'consisting at least in part of', that is to say when interpreting statements in this specification and claims which include that term, the features, prefaced by that term in each statement, all need to be present but other features can also be present.

The invention consists in the foregoing and also envisages constructions of which the following gives examples only.

BRIEF DESCRIPTION OF THE DRAWINGS

Preferred embodiments of the invention will be described by way of example only and with reference to the drawings, in which.

DETAILED DESCRIPTION OF PREFERRED EMBODIMENTS

The present invention relates to a pressure wave generator for driving cryogenic refrigerator systems, such as, for example, Stirling, pulse tube, and/or Gifford McMahon systems. At a broad level, the pressure wave generator utilises at least one pair of reciprocating diaphragms to generate reciprocating pressure waves for driving one or more cryogenic refrigerator systems, although it is possible to utilise a single diaphragm if desired in alternative forms of the pressure wave generator.

Figure 1:
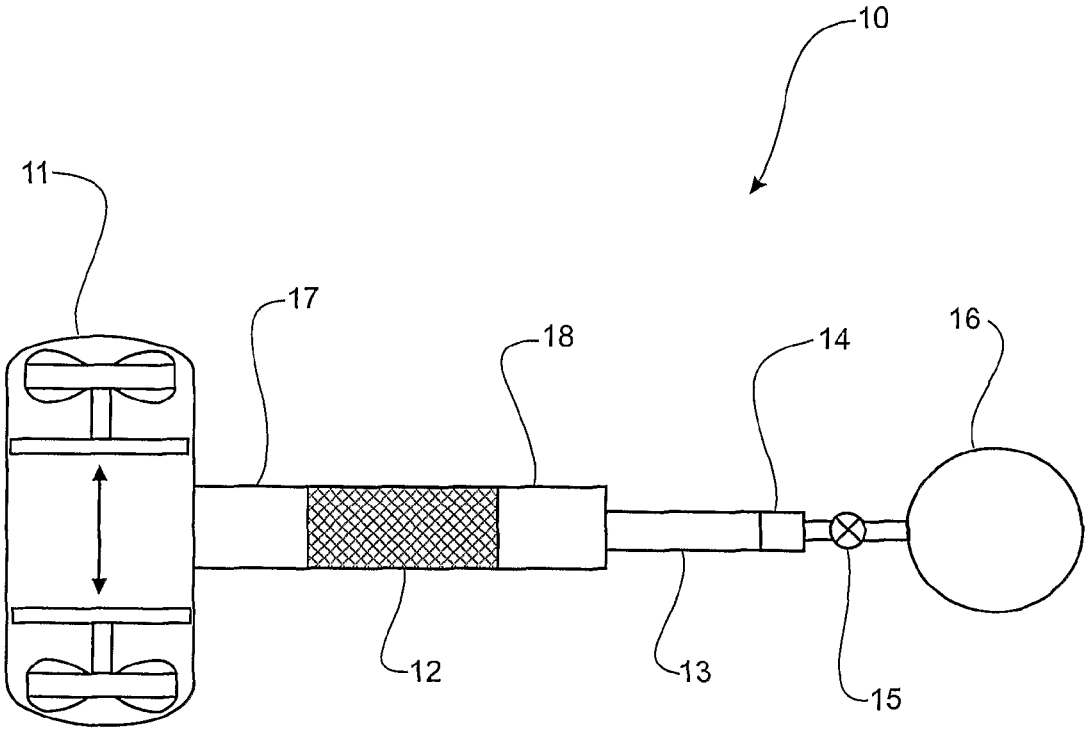
FIG. 1 is a block diagram showing a known pulse tube refrigerator that utilises clearance gap pistons to generate reciprocating pressure waves to drive the refrigerator.
Figure 2:
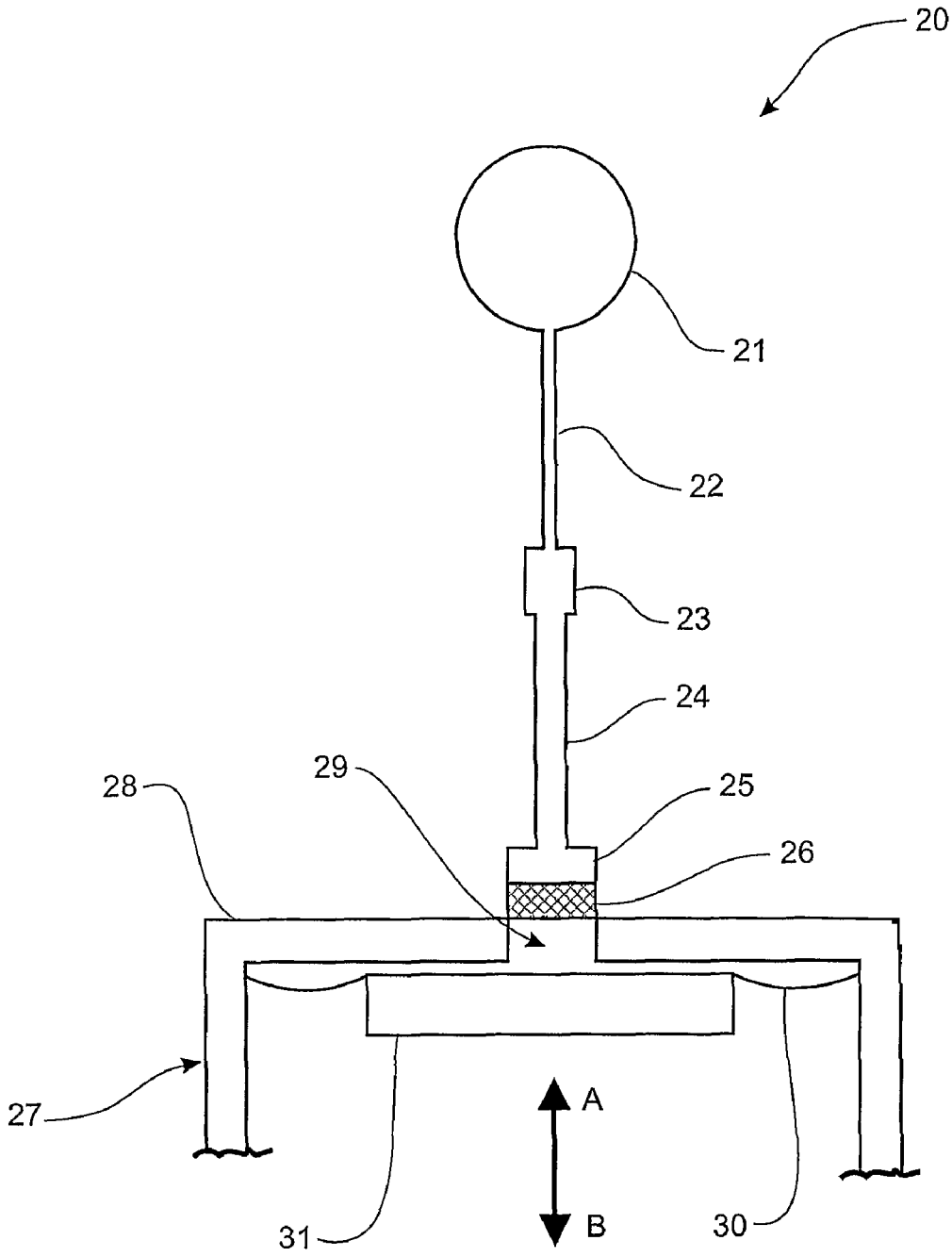
FIG. 2 is a block diagram showing an example of a cryogenic refrigerator system that is driven by a pressure wave generator of the invention.

As mentioned above, the pressure wave generator may be utilised to drive various different types of cryogenic refrigerator systems. FIG. 2 shows, by way of example, an in-line pulse tube cryogenic refrigerator system 20 that is driven by the pressure wave generator. The pulse tube system 20 comprises a reservoir 21, phase shifter 22 (such as an orifice or inertance tube), warm heat exchanger 23, pulse tube 24, cold heat exchanger 25, and a regenerator 26. The pulse tube system 20 is driven by reciprocating pressure waves that are generated by the pressure wave generator 27.

For clarity, only some of the components of the pressure wave generator 27 are shown in FIG. 2. The pressure wave generator 27 comprises a housing 28 that has at least one inlet/outlet port 29 through which the reciprocating pressure waves generated may pass to drive the components of the pulse tube system 20 that is coupled to the inlet/outlet port 29. Typically, the housing will be metal, for example steel, for heat conduction and strength, or aluminium could alternatively be used. The reciprocating pressure waves are generated by at least one diaphragm 30 associated with the inlet/outlet port 29 that is moveable in a reciprocating motion by an operable drive system.

In the preferred form, the diaphragm is annular, with the outer edge being coupled to the housing and the inner edge being coupled to a reciprocating drive part of the drive system. It will be appreciated that the diaphragms need not necessarily be annular in alternative forms of the pressure wave generator. For example, full disc type diaphragms manipulated via drive system force to their center may alternatively be used. The diaphragm may be made from metal or any suitable flexible material such as, for example, rubber, teflon or the like. The diaphragm is preferably formed from material that can seal in the operating gas, for example helium, that drives the cryogenic refrigerator systems connected to the pressure wave generator. Additionally, the diaphragms may be arranged to act as hot or cold heat exchangers in the connected cryogenic refrigerator system or systems and are preferably formed of material that can absorb heat.

Various drive systems may be arranged to manipulate the diaphragm in a reciprocating motion, but preferably the drive system comprises at least one reciprocating piston or piston assembly 31 that is coupled to the inner edge of the diaphragm 30 and that is driven back and forth in the directions shown by arrows A and B.

Figure 3:
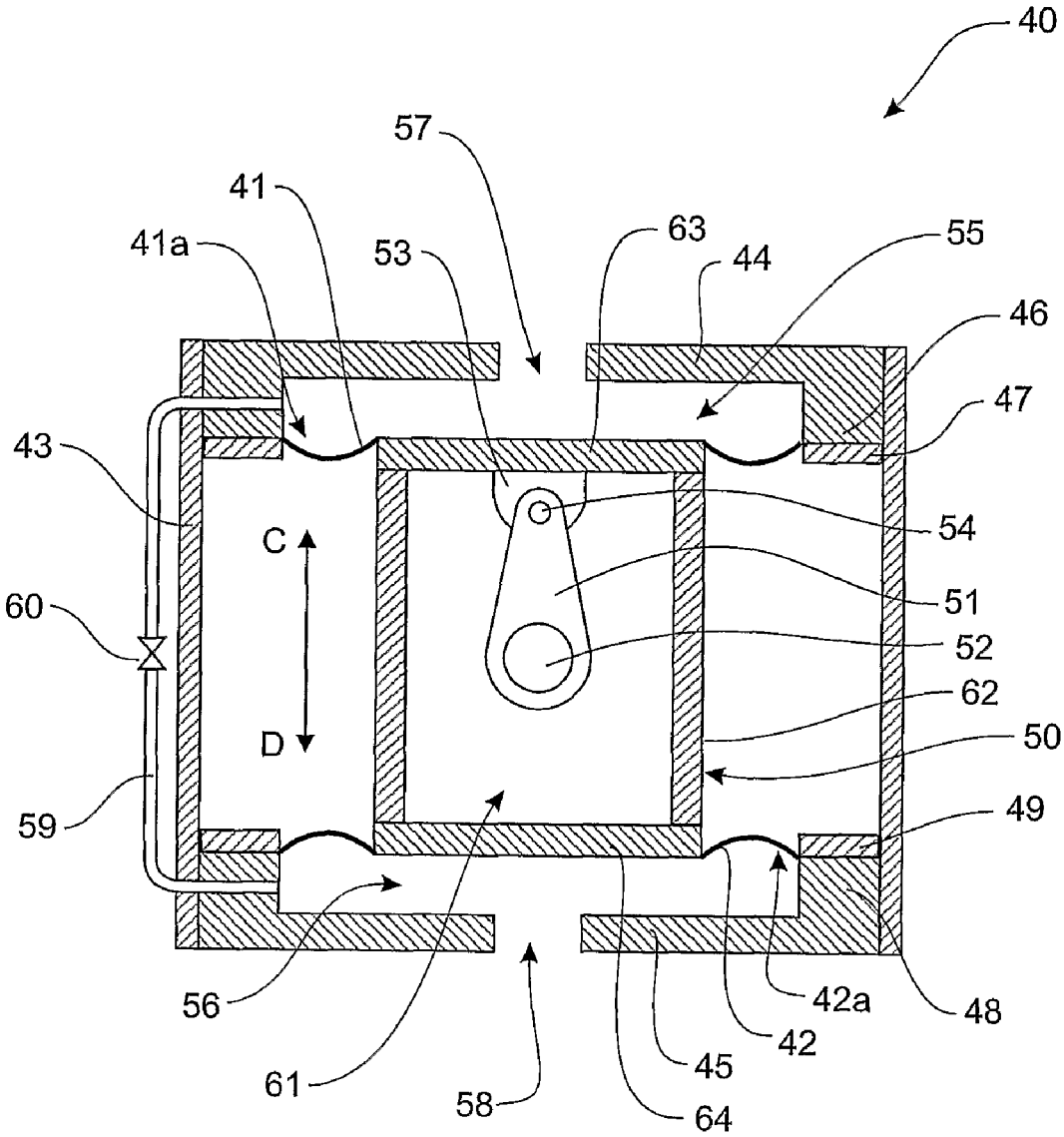
FIG. 3 is a schematic diagram showing a first preferred embodiment pressure wave generator of the invention that utilises a pair of reciprocating diaphragms.
Figure 4:
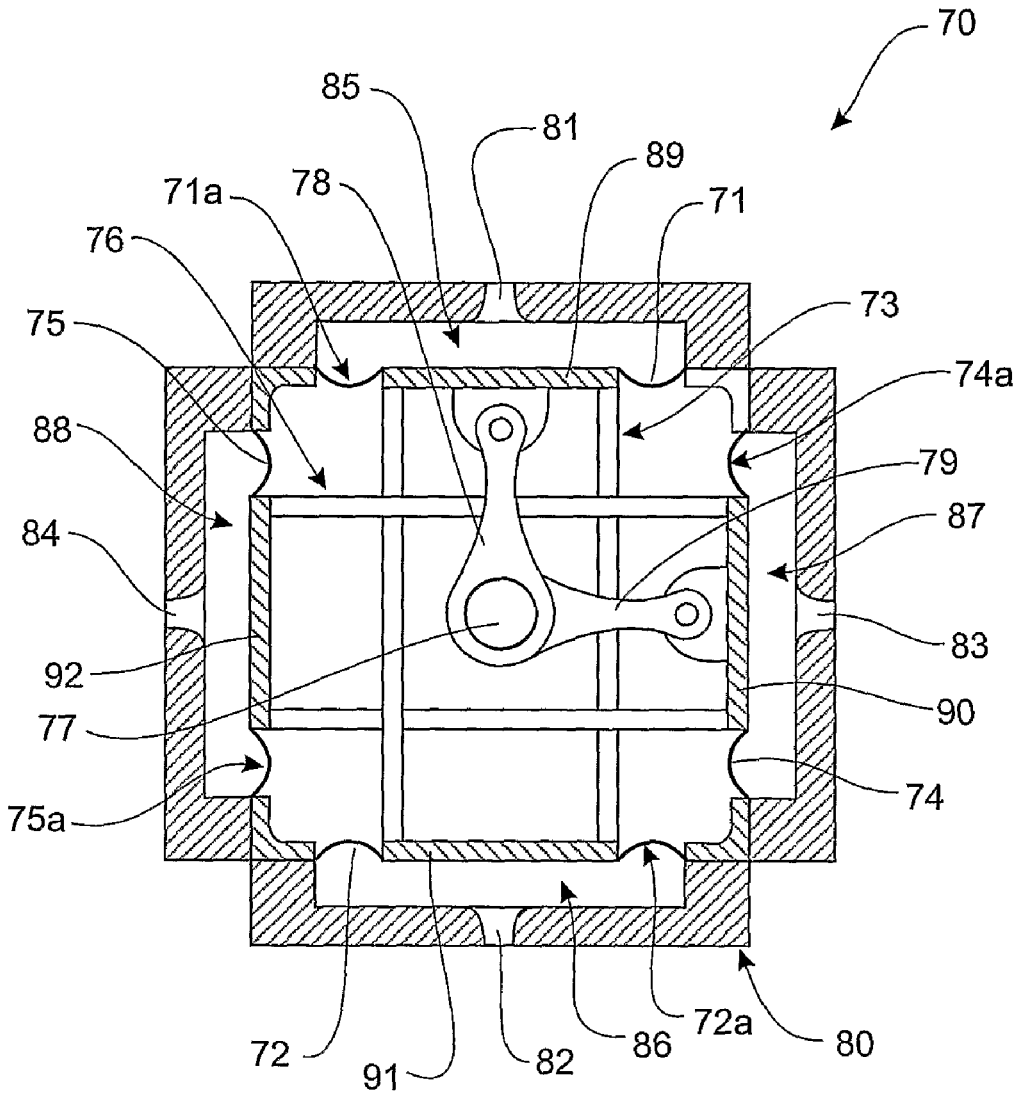
FIG. 4 is a schematic diagram showing a second preferred embodiment pressure wave generator of the invention that utilises two pairs of reciprocating diaphragms.

Referring to FIGS. 3 and 4, two preferred embodiments of the pressure wave generator will be explained by way of example only. The first preferred embodiment of FIG. 3 utilises one pair of reciprocating diaphragms and the second preferred embodiment of FIG. 4 utilises two pairs of reciprocating diaphragms.

Referring to FIG. 3, the pressure wave generator 40 comprises a housing that encloses a pair of opposed diaphragms 41,42 that are arranged to move in a reciprocating motion. The housing is generally comprises side walls 43 and end plates 44,45. It will be appreciated that the housing could be generally cylindrical, box-shaped or any other shape of enclosure as desired. Preferably, the diaphragms 41,42 are annular and the outer edge of each is fixed to or within the housing toward the end plates 44,45. For example, the outer edge of diaphragm 41 may be clamped within the housing between a flange portion 46 of end plate 44 and an adjacent annular clamping component 47 mounted or secured to the flange portion 46 of the end plate 44 or side walls 43 of the housing. Likewise, the outer edge of diaphragm 42 may be secured in a similar fashion between a flange portion 48 of end plate 45 and an adjacent annular clamping component 49. The inner edge of the diaphragms 41,42 are securely fixed at or toward an end of a piston 50, which is the reciprocating drive part of the drive system of the pressure wave generator. It will be appreciated that there are various ways of fixing the inner and outer edges of the diaphragms to the piston and housing respectively, including, for example, fastening components and adhesives. In one form, the inner edges of the diaphragms need not necessarily be actively secured to the ends of the piston, but may be placed on the ends of the piston and can be clamped in place by the gas pressure created in the housing and/or cryogenic refrigerator system.

The piston 50 is driven back and forth in a reciprocating motion in the directions shown by arrows C and D by an operable actuator, for example a connecting rod 51 (conrod) and crank shaft 52 arrangement. One end of the conrod 51 is pivotally coupled to a mounting component 53 within the piston 50 at 54 and the other end of the conrod 51 is operatively coupled to a crank of the crank shaft 52. As the crank shaft 52 rotates, the piston 50 is driven in a reciprocating motion by conrod 51 and this in turn causes the diaphragms 41,42 coupled to the piston to move back and forth in a reciprocating motion. It will be appreciated that various alternative drive systems man be utilised to manipulate the diaphragms in a reciprocating motion and some of these will be described in detail later.

The diaphragms 41,42 are arranged to form compression spaces 55,56 (gas spaces) within the housing. For example, the driving sides 41*a*,42*a* of the diaphragms 41,42 cooperate with the ends of the piston 50 and the end plates 44,45 of the housing to form the compression spaces 55,56, although it will be appreciated that other configurations may alternatively be used. In operation, the diaphragms move in a reciprocating motion within the compression spaces 55,56 to generate reciprocating pressure waves. The pressure waves generated pass or flow through inlet/outlet ports 57,58 provided in the end plates 44,45 of the housing to drive one or more cryogenic refrigerator systems that are connected to the inlet/outlet ports. In particular, the compression spaces 55,56 are provided with a volume of operating gas, such as helium. In operation, the reciprocating diaphragms create pressure waves of the operating gas for driving the cryogenic refrigerator systems via the inlet/outlet ports 57,58 of the housing.

The gas in the compression spaces 55,56 is preferably connected via a connecting pipe 59 to ensure the average gas force is equal. In the preferred form, the connecting pipe also includes an in-line orifice 60 to ensure any flow between the two volumes of gas in negligible. In an alternative form, an orifice is not required. For example, the compression spaces may be connected via the reservoir of a pulse tube refrigerator as the reservoir does not experience a large pressure wave and therefore ensures that any gas flow between the two compression spaces is minimal. With the average gas force on the piston ends and diaphragms 41,42 equalling each other, the net force on the drive system components, for example the conrod 51 and crank shaft 52 is significantly reduced. In operation, the pressure waves generated in compression space 55 are 180 degrees out of phase with those generated in compression space 56.

The pressure wave generator 40 design isolates the operating gas of the cryogenic refrigerator systems from the harsh environment 61 associated with the drive system. In particular, the compression spaces 55,56 are sealed from the moving actuator parts of the drive system, for example the conrod 51 and crank shaft 52. This enables the conrod 51 and crank shaft 52 to be located in a well lubricated chamber for long life, but also enables the operating gas in the compression spaces to be free of contaminants, such as hydrocarbon lubricants, for efficient performance of the cryogenic refrigerator systems.

It will be appreciated that the piston component of the pressure wave generator may be formed in various ways. In the preferred form, the piston 50 is in the shape of a cylinder that has an outer column type wall 62 that has ends plates 63,64. It will be appreciated that the diaphragms 41,42 and end plates 63,64 of the piston 50 can act as heat exchangers to remove the heat of compression.

The side walls 43 of the housing can be considered as being a tension frame that holds the end plates 44,45 of the housing together against the total gas pressure generated by the pressure wave generator.

It will be appreciated that the pressure wave generator 40 can be arranged to drive one or more cryogenic refrigerator systems, of varying types. In one configuration, the pressure wave generator 40 can drive two separate cryogenic refrigerator systems, one system being connected to each of the inlet/outlet ports 57,58. Alternatively, the pressure wave generator 40 can be arranged to drive a single cryogenic refrigerator system, with one of the inlet/outlet ports 57,58 being connected to the cryogenic refrigerator system and the other being blocked off to create a gas spring. The gas spring functions to balance the average gas pressure force. In one form, the gas spring can be used as a reservoir for a pulse tube refrigerator system. It will be appreciated that the inlet/outlet ports 57,58 can each be adapted for connection to multiple cryogenic refrigerator systems if desired also. In particular, each cryogenic refrigerator system does necessarily require its own dedicated inlet/outlet port 57,58.

Vibration generated by the reciprocating motion in the arrangement shown in FIG. 3 can be dynamically balanced using counter rotating balance shafts to generate an opposing reciprocating force.

Referring to FIG. 4, the second preferred embodiment of the pressure wave generator 70 is similar in design to the first embodiment, but has a capacity to drive more cryogenic refrigerator systems. In particular, the pressure wave generator comprises two pairs of opposed reciprocating diaphragms and each of the four diaphragms has an associated compression space and inlet/outlet port for connecting to one or more cryogenic refrigerator systems.

The drive system of the pressure wave generator 70 comprises an actuator that drives two pistons, each piston being coupled to one of the pairs of diaphragms. In particular, the first pair of diaphragms 71,72 are coupled to respective ends of a first piston 73 and the second pair of diaphragms 74,75 are coupled to respective ends of a second piston 76. Both pistons 73,76 are driven in a reciprocating motion by the same actuator, for example a single crank shaft 77. In particular, the crank shaft 77 drives the first piston 73 via conrod 78 and the second piston 76 via conrod 79. The conrods 78,79 are connected at one end to their respective pistons 73,76 in a manner similar to that described with respect to the first embodiment. The opposite ends of the conrods 78,79 are operatively coupled to separate cranks provided on the crank shaft 77. In the preferred form, one crank leads the other by 90 degrees and the two pairs of diaphragms are substantially perpendicular or orthogonal to each other looking down the crank shaft 77. The drive system arrangement can be dynamically balanced with a counterweight on the crank shaft 77.

Vibration generated by the reciprocating motion in the arrangement shown in FIG. 4 can be dynamically balanced by a crank shaft counterweight.

As with the first preferred embodiment, the pressure wave generator 70 comprises a housing 80 that encloses the four diaphragms 71,72,74,75 and the drive system. The walls of the housing may act as heat exchangers when driving a cryogenic refrigerator system. Also, associated with each diaphragm 71,72,74,75 is a respective inlet/outlet port 81,82,83,84 through which generated pressure waves may pass to drive one or more cryogenic refrigerator systems connected to the inlet/outlet ports 81,82,83,84. Like the first preferred embodiment, the pressure waves are generated by reciprocating movement of the diaphragms 71,72,74,75 in respective compression spaces 85,86,87,88 that are formed by the driving sides 71*a*,72*a*,74*a*,75*a* of the diaphragms 71,72,74,75, end plates 89,90,91,92 of the pistons 73,76, and the walls of the housing 80. Balancing of gas forces is achieved in a similar manner to that described with respect to the first preferred embodiment. In particular, each pair of diaphragms has an associated connection pipe, preferably with an in-line orifice, that is arranged to connect the two compression spaces associated with that pair. For clarity, these connection pipes are not shown in FIG. 4.

The pressure wave generator 70 essentially utilises four diaphragms 71,72,74,75 that are driven off a single crank shaft 77 in a square arrangement. The end plates 89,90,91,92 of the pistons 73,76 move in and out 90 degrees to generate pressure waves with a corresponding phase differential with respect to each other.

The pressure wave generators 40,70 described with reference to FIGS. 3 and 4 can be configured in various arrangements to drive various types of cryogenic refrigerators and some possible configurations will now be described with reference to FIGS. 5-9. It will be appreciated that the compression spaces of the pressure wave generators may act as expansion spaces depending on the gas flow in some configurations.

Stirling Refrigerator Systems

Figure 5:
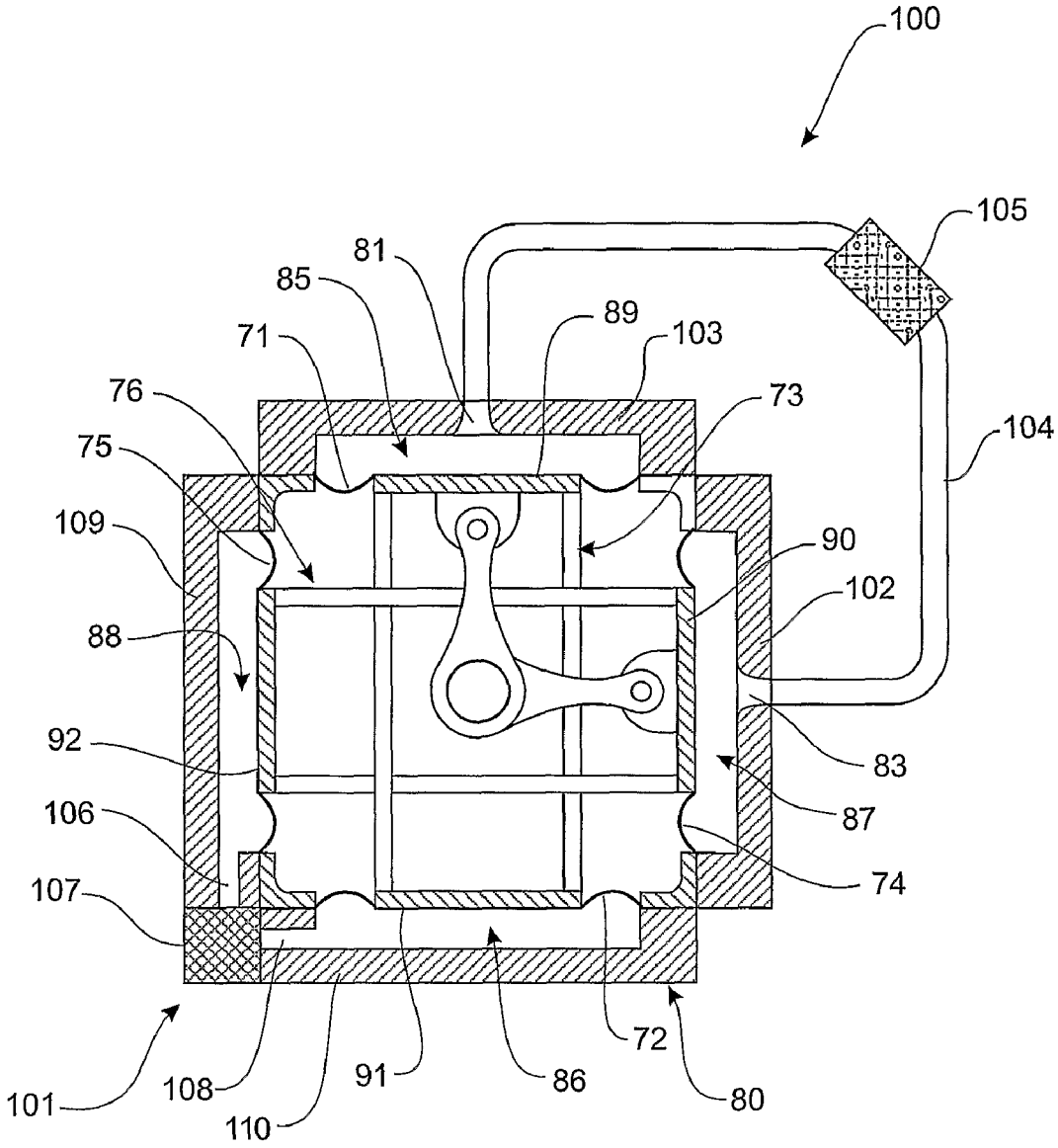
FIG. 5 is a schematic diagram showing a Stirling refrigerator that is driven by a pressure wave generator of the invention.

Referring to FIG. 5, the pressure wave generator described with reference to FIG. 4 can be utilised to drive Stirling refrigerator systems. Two Stirling refrigerator system configurations are shown, by way of example only. It will be appreciated that the pressure wave generator can drive both simultaneously or either alone.

The first Stirling refrigerator system 100 is driven by diaphragms 71 and 74, which are driven 90 degrees out of phase with respect to each other. Space 87 acts as a compression space and is associated with inlet/outlet port 83. Space 85 acts as an expansion space and is associated with inlet/outlet port 81. The wall 102 of the housing 80 associated with diaphragm 74, diaphragm 74 itself and the end plate 90 of piston 76 are arranged to form a hot heat exchanger. Likewise, the wall 103 of the housing 80 associated with diaphragm 71, diaphragm 71 itself and the end plate 89 of piston 73 are arranged to be a cold heat exchanger. A connecting pipe or tube 104, with an in-line regenerator 105, connects the inlet/outlet port 83 to the inlet/outlet port 81 to allow the Stirling cycle to run.

The second Stirling refrigerator system 101 does not utilise piping or the inlet/outlet ports of the pressure wave generator to connect the compression and expansion spaces. Rather, the system 101 utilises edge tappings into the housing of the pressure wave generator. The system 101 is driven by diaphragms 72 and 75. The inlet/outlet ports associated with each diaphragm 72,75 are blocked. Space 88 forms a compression space with the inlet/outlet port being edge tapping or channel 106 formed in the housing that leads to regenerator 107. Space 86 forms an expansion space with the inlet/outlet port being the edge tapping or channel 108 leading from the regenerator 107. The wall 109 of the housing 80, diaphragm 75 and end plate 92 of piston 76 associated with compression space 88 form a hot heat exchanger. The wall 110 of the housing 80, diaphragm 72 and end plate 81 of piston 73 associated with expansion space 86 form a cold heat exchanger.

Pulse Tube Refrigerator Systems

Figure 6:
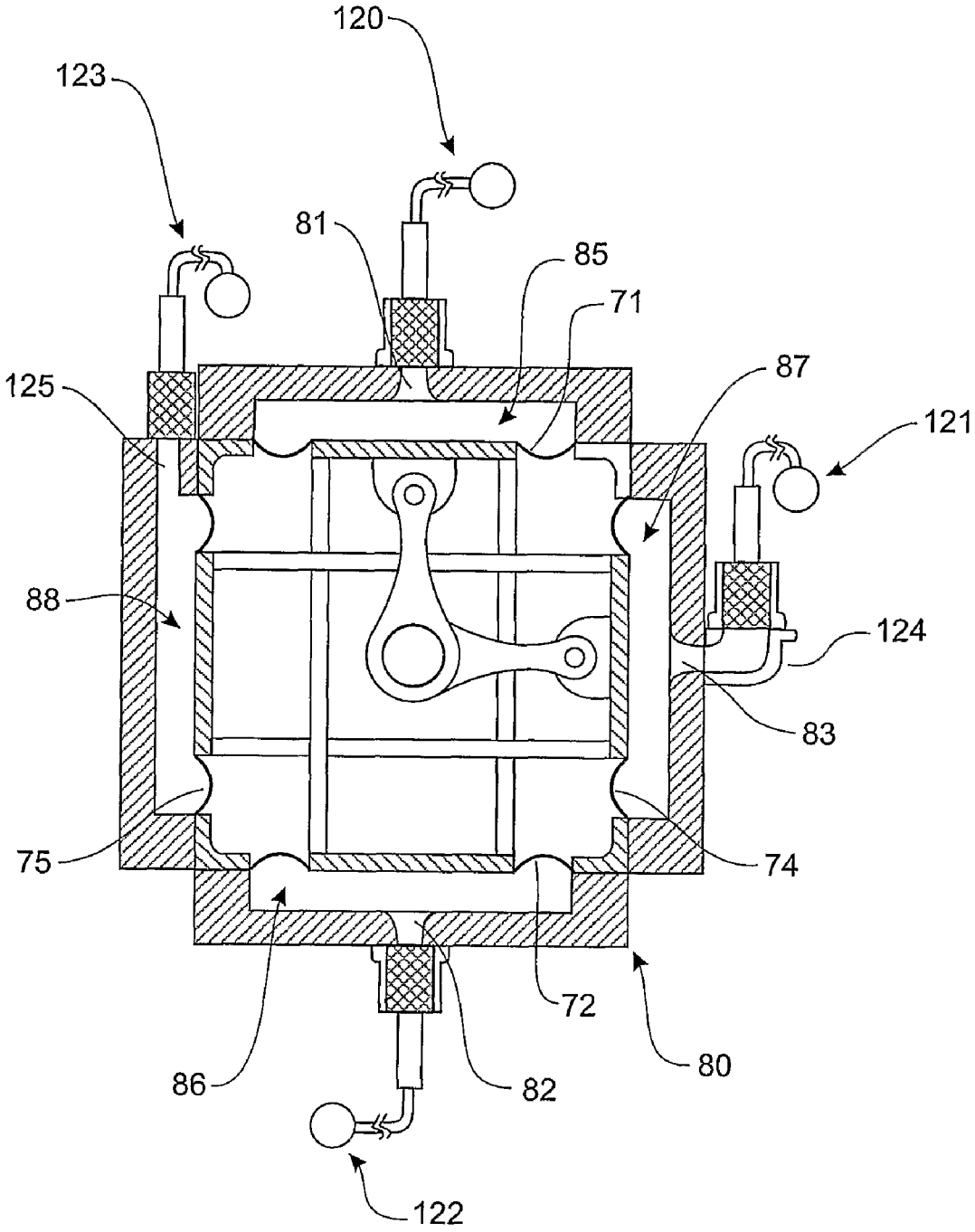
FIG. 6 is a schematic diagram showing a number of pulse tube refrigerators being driven by a pressure wave generator of the invention.

Referring to FIG. 6, the pressure wave generator described with reference to FIG. 4 can be utilised to drive one or more pulse tube refrigerator systems. The components of a pulse tube refrigerator system driven by the pressure wave generator have been described with reference to FIG. 2.

FIG. 6 shows how the four diaphragm arrangement of FIG. 4 can be connected to pulse tube refrigerator systems. Because pulse tubes work best vertically, horizontal arrangements from the four diaphragm arrangement can accommodate pulse tubes with either a 90 degree bracket or an edge tapping if required.

Each of the pulse tube refrigerator systems 120,121,122, 123 shown is driven by one of the diaphragms 71,74,72,75 of the pressure wave generator and each space 85,87,86,88 associated with the diaphragms is a compression space. Pulse tube refrigerator systems 120 and 122 are connected directly to respective inlet/outlet ports 81 and 82 of the pressure wave generator. Pulse tube refrigerator system 121 utilises a 90 degree or right-angled bracket 124 to connect to inlet/outlet port 83 to provide the desired vertical orientation. An edge tapping, side take-off or channel 125 is provided as an inlet/outlet port for pulse tube refrigerator system 123, with the conventional inlet/outlet port being blocked.

It will be appreciated that the pressure wave generator man drive all four pulse tube refrigerator systems simultaneously, or each alone if desired.

Free Displacer Piston Stirling Cooler System

Figure 7:
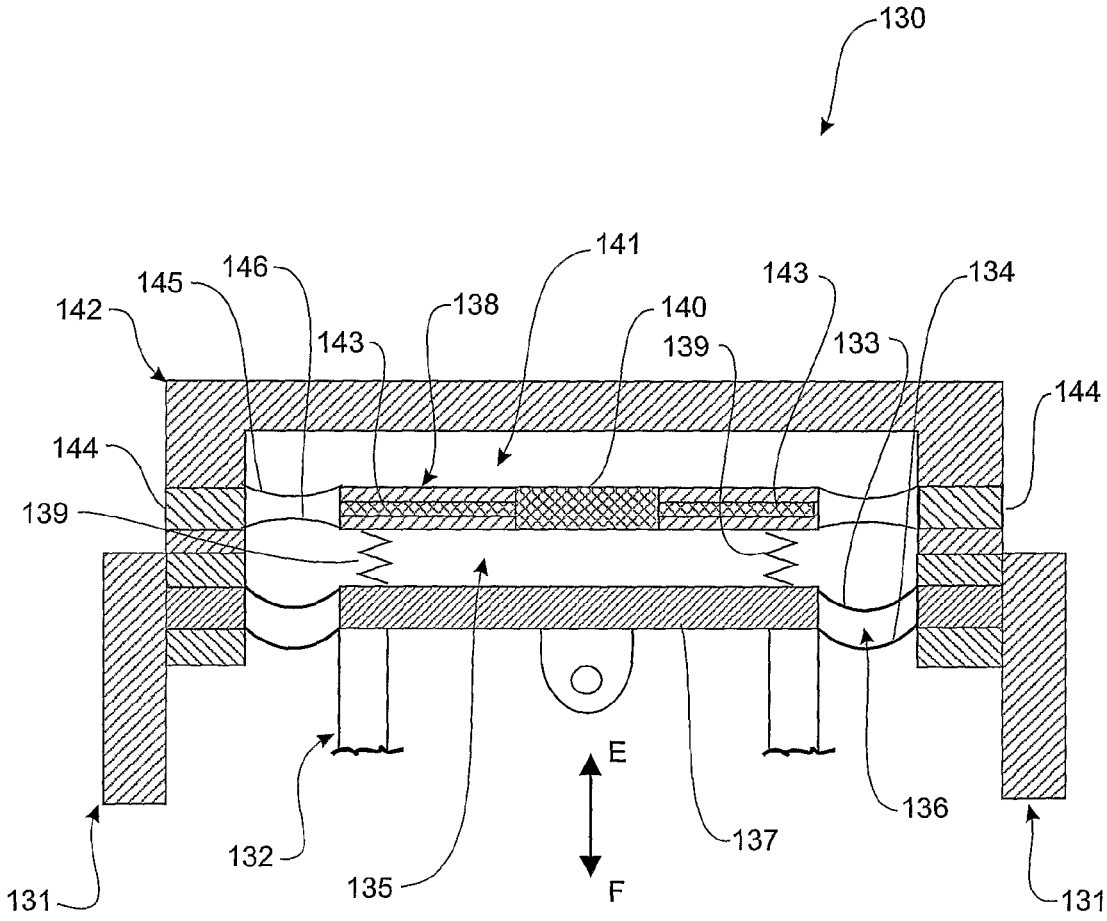
FIG. 7 is a schematic diagram showing a free displacer piston Stirling cooler being driven by a pressure wave generator of the invention.

Referring to FIG. 7, a free displacer piston Stirling cooler system 130 is shown that can work with either the two or four diaphragm arrangements described above with reference to FIGS. 3 and 4. The free displacer piston Stirling cooler system 130 will be described with reference to the partial view of the pressure wave generator shown in FIG. 7. The driving piston 132 and housing or tension frame 131 are similar to that described with reference to FIGS. 3 and 4.

In this system 130, two adjacent dual diaphragms 133 and 134 are driven back and forth in a reciprocating motion by piston 132 as indicated by arrows E and F. In operation, the diaphragms 133,134 generate pressure waves in compression space 135 and the gap 136 between the diaphragms 133,134 allows cooling of the compression space. The end plate 137 of the piston 132 acts as a hot heat exchanger and is cooled.

In the preferred form, the free piston or displacer 138 is mounted on the driving piston 132 with springs 139 or the like. Alternatively, the displacer 138 could be driven by the pressure wave generated by the diaphragms 133,134. Dual adjacent displacer diaphragms 145,146 are coupled between the housing and the displacer 138. In particular, the inner edges of the annular diaphragms 145,146 are fixed to the outer periphery of the displacer 138 and the outer edges are fixed to or within the housing. In the preferred form, there is a vacuum between the displacer diaphragms 145,146. The vacuum between the diaphragms servers as insulation between the hot (compression) and cold (expansion) gas spaces. The displacer and displacer diaphragms 145,146 form a divide between the compression space 135 and expansion space 141.

In operation, the displacer 138 is in a state of resonance with its movement 90 degrees out of phase with the driving piston 132 thus operating a Stirling cycle. The regenerator 140 is inside the displacer 138 and is arranged to allow gas to flow from the compression space 135 to the expansion space 141 and back. Wall 142 of the housing acts as a cold heat exchanger. Insulation between hot and cold parts of the cycle is achieved with insulating packers 143 of the displacer 138 and insulating packers 144 of the housing and the vacuum between the diaphragms.

Free Expansion Piston Stirling Cooler System

Figure 8:
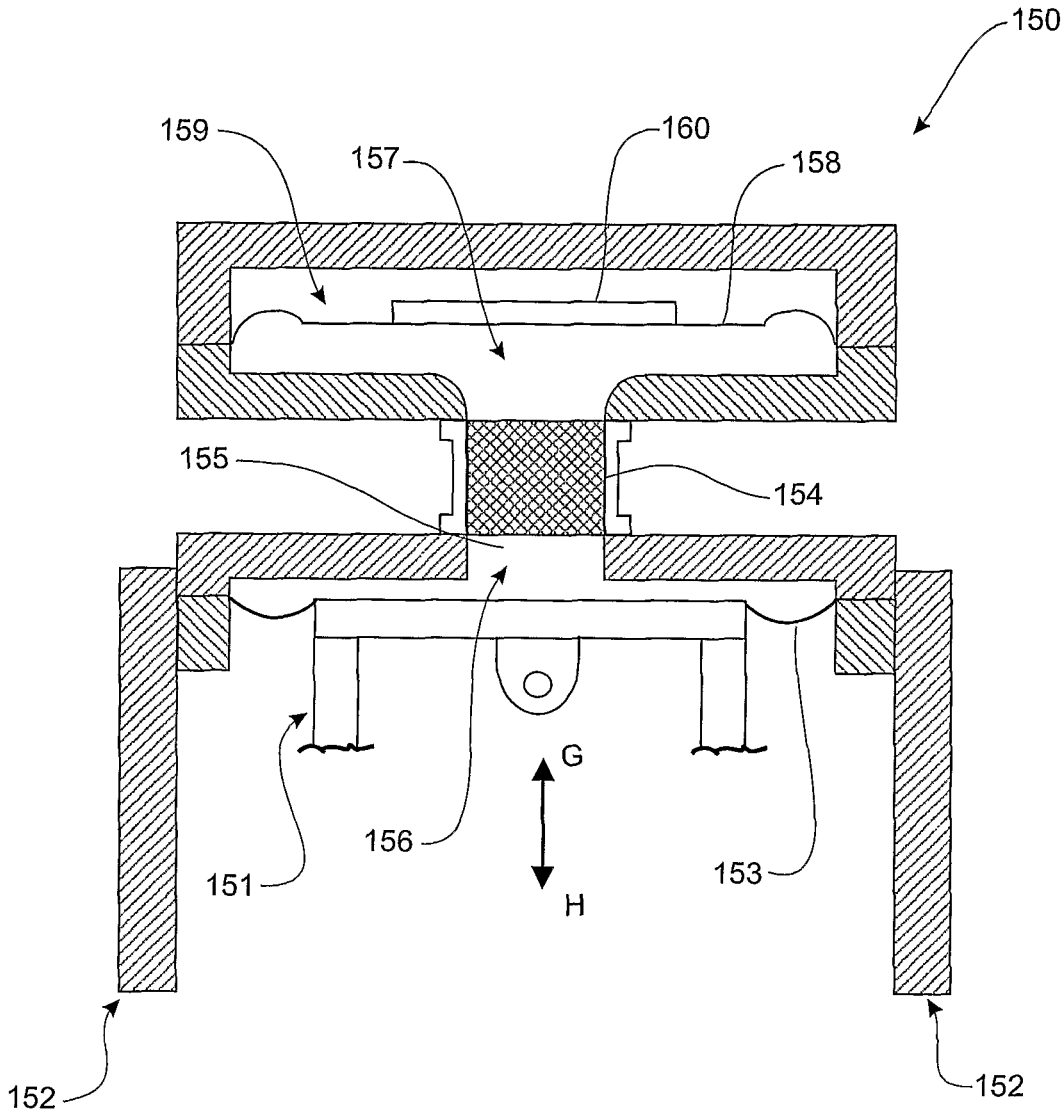
FIG. 8 is a schematic diagram showing a free expansion piston Stirling cooler being driven by a pressure wave generator of the invention.

Referring to FIG. 8, a free expansion piston Stirling cooler system 150 is shown that can work with either the two or four diaphragm arrangements described above with reference to FIGS. 3 and 4. The free expansion piston Stirling cooler system 150 will be described with reference to the partial view of the pressure wave generator shown in FIG. 8. The driving piston 151, housing or tension frame 152 and diaphragm 153 are similar to that described with reference to FIGS. 3 and 4. In particular, the piston 151 is driven back and forth in a reciprocating motion as indicated by arrows G and H to cause the diaphragm 153 to move in a corresponding manner to generate pressure waves of operating gas.

In this system 150, a stationary regenerator 154 is mounted to the inlet/outlet port 155 associated with diaphragm 153 between the compression 156 and expansion 157 spaces of the system. An expansion diaphragm 158, for example a disk shaped diaphragm, is also provided and is arranged to resonate with the pressure waves, its movement being 90 degrees out of phase thus operating a Stirling cycle. A gas spring 159 counters the average gas force on the expansion diaphragm 158. Resonance is controlled by the properties of the diaphragm mass 160 and gas spring 159. It will be appreciated that mechanical springs may alternatively be used if desired.

Gifford McMahon Style Cryogenic Refrigerator System

Figure 9:
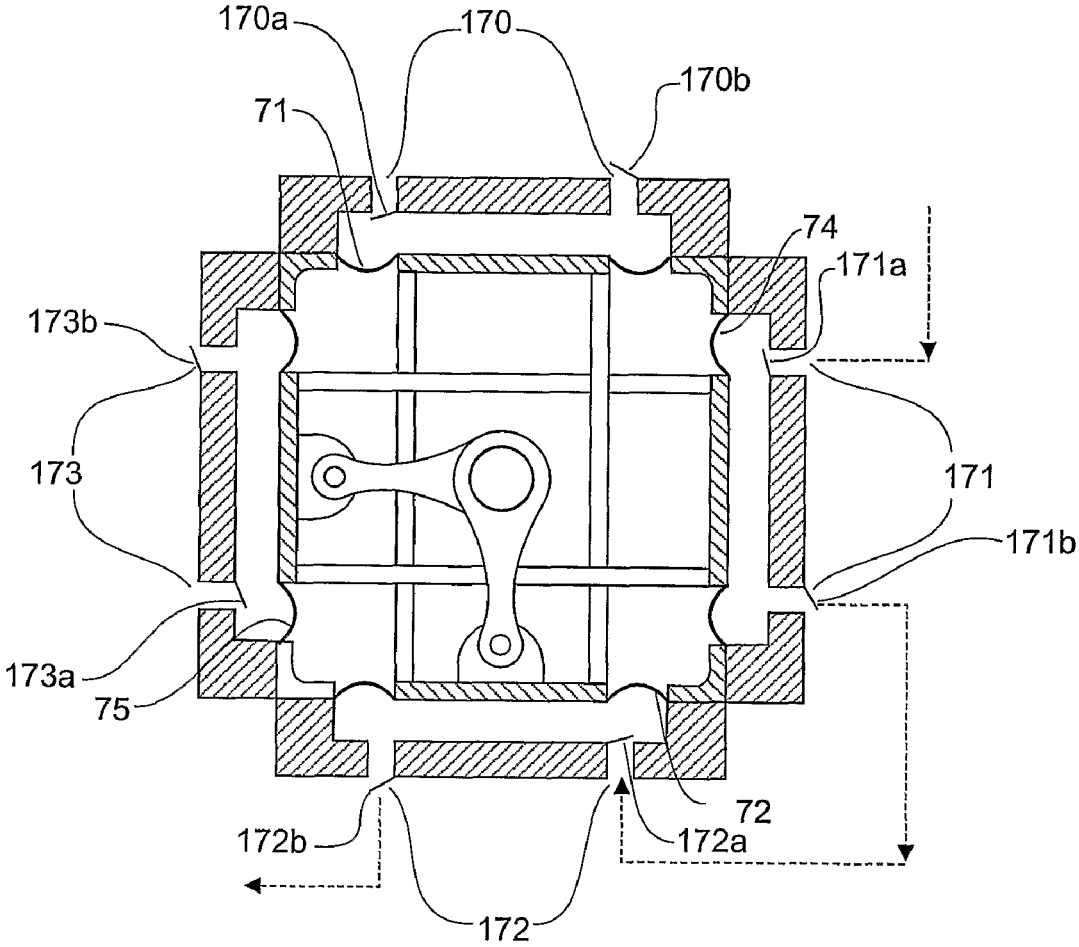
FIG. 9 is a schematic diagram showing a pressure wave generator of the invention with check valves for driving a Gifford McMahon style cryogenic refrigerator.

Referring to FIG. 9, the pressure wave generator of FIG. 4 can be configured with dual ports 170,171,172,173 instead of single central inlet/outlet ports for each of the diaphragms 71,74,72,75. In particular, each set of dual ports 170,171,172,173 have operable inlet check valves 170*a*,171*a*,172*a*,173*a* and operable outlet check valves 170*b*,171*b*,172*b*,173*b* to control the flow of gas through the ports as desired. It will be appreciated that any type of suitable directional valve may be utilised.

The pressure wave generator, equipped with dual ports and valves, can be configured as a standard compressor suitable for compressing a working gas such as helium for use in a Gifford McMahon style cryogenic refrigerators. For example, connecting the outlet port of one diaphragm, for example outlet 171*b*, into inlet of the next diaphragm, for example inlet 172*a*, enables multistage compression for higher compression ratios. It will be appreciated that the pressure wave generator could provide two, three or four stages of compression with the arrangement shown. It will be appreciated that the pressure wave generator of FIG. 3 could also be modified to have dual ports and inlet/outlet check valves for various applications if desired.

Drive Systems for Pressure Wave Generator

In operation, the drive system must deliver considerable force, over a relatively small distance, to the diaphragm to generate the pressure waves required to drive the cryogenic system or systems that are connected to the pressure wave generator.

The drive system for manipulating the diaphragms of the pressure wave generator described above with respect to FIGS. 2-9 comprises a piston or pistons that are driven directly by an actuator, for example a conrod and crank shaft arrangement. Alternative lever-based drive systems for the pressure wave generators of FIGS. 2-9 will now be explained.

At a broad level, the lever-based drive systems also comprise a reciprocating piston or pistons that are coupled to one or more diaphragms to generate pressure waves. However, instead of the piston or pistons being driven directly by an actuator as previously described, the piston or pistons are driven in a reciprocating motion by an actuator that is operatively coupled to the piston via a pivotable lever. In particular, the lever is pivotably mounted at one end to a fixed pivot point within the housing and its free end is coupled to a reciprocating actuator that is operable to pivot the free end of the lever in a reciprocating arc about the pivot point. As the lever is moved back and forth along the reciprocating arc, the piston is reciprocated back and forth to cause the diaphragm to generate reciprocating pressure waves.

These lever based drive system arrangements are mechanically more efficient than the directly coupled actuator arrangements previously described as the actuator can apply a small force over a large distance to generate the required large force over a small distance for the diaphragm in accordance with the lever arm ratio.

Two preferred embodiments of the lever-based drive system will now be described. The first preferred embodiment utilises an arrangement of flexible linkage or links to provide a pivot point for the lever and will be described with reference to FIGS. 10, 11*a* and 11*b*. The second preferred embodiment of the lever-based drive system utilises a pivotable coupling for the lever and will be described with reference to FIGS. 12, 13*a*, 13*b* and 14.

Figure 10:
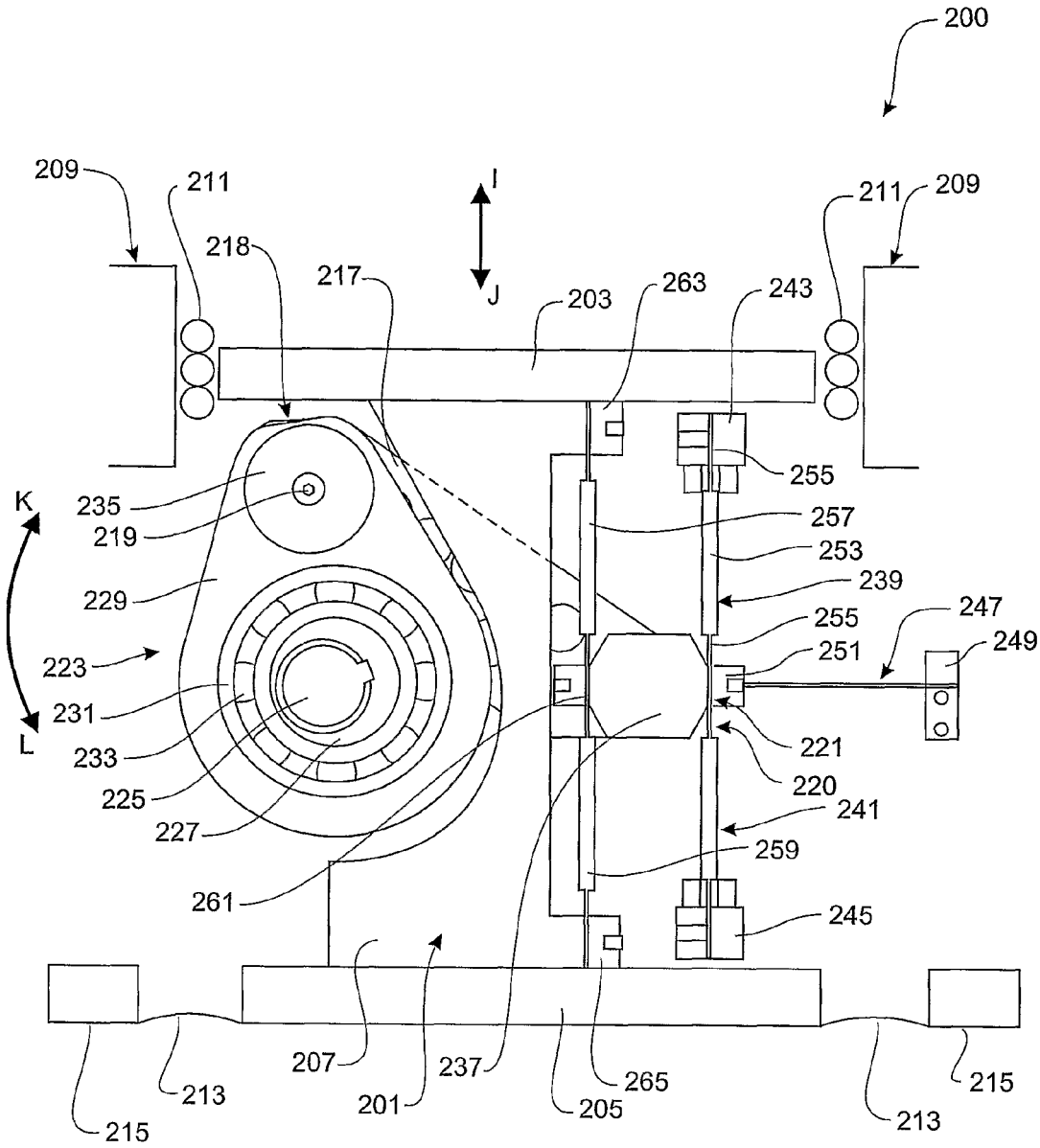
FIG. 10 shows a side view of a pressure wave generator of the invention that is driven by a drive system that utilises flexible linkages to create a pivot point for a reciprocating lever.

Referring to FIG. 10, a first preferred embodiment of the lever-based drive system for a pressure wave generator, generally identified by 200, is shown. The pressure wave generator 200 comprises a housing that has one or more inlet/outlet ports through which generated pressure waves may pass, although these are not shown. All components of the pressure wave generator 200 are mounted within the housing. The pressure wave generator 200 further comprises a diaphragm 213 that is driven in a reciprocating motion by the drive system. The drive system comprises a piston or piston block 201 with top 203 and bottom 205 end plates that are provided at each end of a central member 207. The piston 201 is arranged to reciprocate back and forth in a path indicated by arrows I and J.

In a preferred form, the top 203 and bottom 205 plates are circular and the piston 201 is arranged to reciprocate back and forth within a circular guide wall 209 that is fixed within the housing and located about the periphery of the top plate of the piston. Bearings 211 are provided between the outer perimeter of the top plate 203 and the inner surface of the guide wall 209 to enable relative movement. It will be appreciated that other slidable arrangement could be utilised to guide the top plate 203 of the piston 201 as it moves back and forth. The lower plate 205 of the piston 201 is coupled to the diaphragm 213. The diaphragm may be made from metal or any suitable flexible material such as, for example, rubber, teflon or the like. The diaphragm is preferably formed from material that can seal in the operating gas, for example helium, that drives the cryogenic system connected to the pressure wave generator 200. In the preferred form, the diaphragm 213 is annular with the inner edge being securely fixed to the outer periphery of the bottom plate 205 and the outer edge being securely fixed or anchored to or within the housing at mounting points 215. In operation, the reciprocating motion of the piston 201 causes a corresponding reciprocating movement of the diaphragm 213 to cause a pressure wave to be generated to drive a cryogenic refrigerator system connected to an associated inlet/outlet port of the housing. It will be appreciated that the piston 201 may be coupled to a diaphragm at each end or more than one diaphragm at each end to create multiple pressure waves if desired as previously described.

The piston 201 is moved in a reciprocating motion by an operable actuator that is operatively coupled to the piston via a pivotable lever 217. In the preferred form, a first end 218 of the lever 217 is coupled to a reciprocating actuator 223 at point 219 and a second end 220 of the lever is coupled to a rigid pivot point 221. In operation, the actuator 223 is operable to drive the first end 218 of the lever 217 in a reciprocating arc back and forth in directions indicated by arrows K and L about pivot point 221.

In the preferred form, the actuator 223 comprises a crank shaft and conrod (connecting rod) arrangement. In particular, a connecting member 229 extends between the lever 217 and a rotatable crank shaft 225. The connecting member 229 is pivotally coupled at point 219 via coupling 235 to the first end 218 of the lever 217 and is coupled to a crank 227 (part of the crank shaft that has an eccentric diameter or an eccentrically mounted crank) of the crank shaft 225. The coupling 235 at 219 is a pivotable connection such as a pin joint or any other coupling that securely connects two components but allows relative pivotable movement between them. In operation, the crank 227 is arranged to rotate within a complementary aperture 231 of the connecting member 229 and a bearing 233 is provided between the exterior periphery of the crank 227 and inner periphery of the aperture 231 of the connecting member 229 to allow for rotation. It will be appreciated that there may be two connecting members 229 located on opposite sides of the lever and being driven by the same crank shaft in an alternative embodiment.

In operation, the crank shaft 225 is rotated by a drive source, such as a motor or any other rotatable drive source, and the crank 227 rotates to cause the connecting member 229 to reciprocate up and down to thereby cause the lever 217 to reciprocate back and forth along an arc indicated by arrows K and L about pivot point 221. As the lever 217 reciprocates about pivot point 221, the piston 201 and diaphragm 213 are caused to have a corresponding reciprocal up and down motion as indicated by arrows I and J. In the preferred form, each rotation of the drive shaft causes an oscillation of the piston 201 to thereby cause an oscillation of the diaphragm 213 to generate a pressure wave.

Figure 11B:
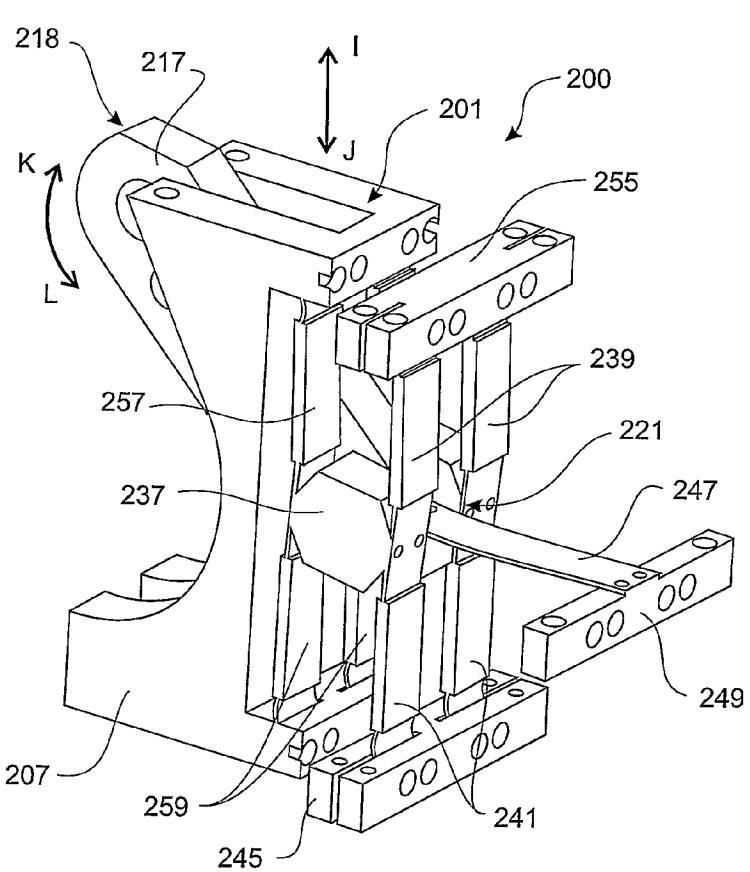
FIGS. 11*a* and 11*b* show perspective views of drive system components of the pressure wave generator of FIG. 10 in operation.
Figure 11A:
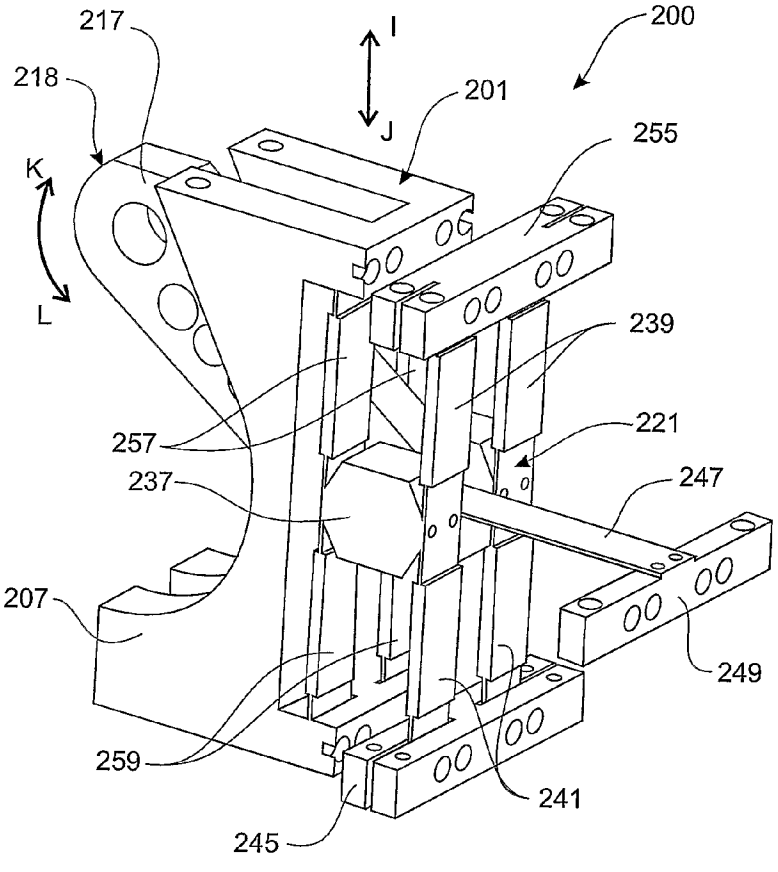

The preferred form rigid pivot point 221 at the second end 220 of the lever 217 is provided by an arrangement of flexible linkage members or flexible links that are coupled to the second end of the lever. In particular, the second end 220 of the lever 217 is provided with a coupling component 237 that is securely fixed at pivot point 221 to an arrangement of flexible links. In particular, the arrangement of flexible links comprises upper 239 and lower 241 flexible links that extend from pivot point 221 to fixed upper 243 and lower 245 stationary supports respectively that are securely fixed to or within the housing. A lateral flexible link 247 is also provided that extends from pivot point 221 to a fixed lateral support 249 that is mounted securely to or within the housing. In the preferred form, there are a pair of upper 239 and lower 241 flexible links that are substantially parallel to each other, and a single lateral flexible link 247 that is located between the upper 239 and lower 241 flexible link pairs as shown in FIGS. 11*a* and 11*b*. It will be appreciated that the flexible links 239, 241, 247 may be secured to the coupling component 237 of the lever 217 via any type of fastening component or components such as, for example, bolts, screws, rivets or the like. The preferred form fastening components are bolts 251 that are arranged to extend through the flexible links 239, 241, 247 and into the coupling component 237 at the second end 220 of the lever 217.

In operation, the arrangement of flexible links 239, 241, 247 creates a rigid pivot point 221 or fulcrum about which the lever 217 may pivot. The flexible links 239, 241, 247 are rigid in tension and compression, but can bend easily, the net effect being a pivot point 221. As will be explained later, the links 239, 241, 247 flex to create a rigid pivot point 221 as force is applied to the first or free end 218 of the lever 217 to reciprocate it back and forth along arc indicated by arrows K and L. The flexible links can be formed from any suitable strong but resiliently flexible material or materials. In a preferred form, the upper and lower links 239 may comprise a rigid centre portion 253 and flexible end sections or portions 255. The preferred form lateral flexible link 247 is entirely and uniformly formed from a resiliently flexible material. In a preferred form, the links would comprise a high strength metal able to transmit high forces without failure.

As previously mentioned, the lever 217 is also coupled to the piston 201 to move the piston 201 up and down in a path that is guided either by a cylinder or guide wall 209 and/or diaphragm 213. In a preferred form, upper 257 and lower 259 flexible linkages or links couple the lever 217 to the central member 207 of the piston 201. The upper 257 and lower 259 links are bolted at one end to the coupling component 237 of the lever 217 at point 261 and at the other end to upper 263 and lower 265 parts of the central member 207 of the piston 201. It will be appreciated that alternative fastening mechanisms or components can be utilised. In a preferred form, the upper 257 and lower 259 links are similar in form to the upper 239 and lower 241 links of the rigid pivot arrangement. In particular, there are upper 257 and lower 259 pairs of links as shown more clearly in FIGS. 11*a* and 11*b*. Point 261 moves in a small arc dictated by the lever arm ratio as the lever 217 reciprocates. The corresponding small changes of angle and lateral movement of the piston 201 are accommodated by the coupling arrangement of the flexible links 257, 259 as they bend as the piston reciprocates up and down in a path indicated by arrows I and J.

It will be appreciated that the flexible links may be arranged in alternative ways to provide the pivot point for the lever and to couple the lever to the piston 201. For example, it is not necessary to have pairs of upper 239 and lower 241 links and a lateral link 247 for the pivotable arrangement. There maybe a single flexible component that performs the function of the upper and lower links. In particular, the upper and lower links may be integral with each other and the lateral link if desired. Similar alternatives are available for the flexible links 257, 259 that coupled the lever 217 to the piston 201.

It will be appreciated that the actuator that drives the lever in the reciprocating arc indicated by arrows K and L may be any other mechanical actuator or an electric, hydraulic, or pneumatic actuator, or any combination thereof. It does not necessarily have to be a crank shaft and conrod arrangement as previously described. The drive system may utilise any reciprocating drive mechanism to manoeuvre the free end 218 of the lever 217 up and down as desired. Further, a control system may be provided to enable a user to control the displacement and speed of lever motion to thereby control the displacement and speed of motion of the piston and diaphragm. The ability to control the speed and displacement of the lever enables the specification of pressure waves generated by the diaphragm to be controlled in terms of frequency and pressure or force. The possible actuator variations and control system capabilities mentioned above also apply to the directly coupled actuator drive system described initially with respect to FIGS. 2-9.

The lever based drive system enables the actuator 223 of the drive system to create a large force over a small displacement at the piston to drive the diaphragm with reduced force over a larger displacement at the actuator. This enables bearings 233 of a reduced size to be utilised in the crank shaft and conrod arrangement compared with a crank shaft and conrod arrangement that directly drives the piston. Smaller bearings reduce bearing friction and increase mechanical efficiency of the drive system. Further, the pressure wave generated by the diaphragm represents a considerable force and the diaphragm movement is relatively small. The flexible link arrangement that creates a pivot point 221 for the lever 217 means that there are no moving parts or bearings where the loads are high and movements small, thereby increasing mechanical efficiency and reducing unwanted movements caused by play in the bearings. The stresses in the flexible links are preferably kept below their material endurance limit and therefore the links may effectively have an infinite life and may last longer than equivalent linkages that use bearings.

Referring to FIGS. 11*a* and 11*b*, operation of the pressure wave generator 200 will now be described. For clarity, not all components of the pressure wave generator 200 are shown. In particular the top 203 and bottom 205 plates of the piston 201, actuator 223, diaphragm 213 and piston guide walls 209 have been omitted. FIG. 11*a* shows the lever 217 in an intermediate or rest position midway through its reciprocating arc indicated by arrows K and L. In this intermediate position, the flexible links 239, 241, 247 that create the pivot point 221 are not bent and are in a rest state. Likewise, the flexible links 257, 259 that couple the lever 217 to the piston 201 are also not bent and are in a rest state. Referring to FIG. 11*b*, the lever 217 has been moved upward in direction K along its reciprocating arc by the actuator 223 (not shown). As the lever 217 is moved upward by the actuator 233 the flexible links 239, 241, 247 bend or flex to create a pivot point 221 or fulcrum about which the lever 217 can pivot. As the lever 217 pivots in direction K, the piston 201 also moves up in direction I as it is connected to the lever 217 by the upper 257 and lower 259 flexible links. As previously described, these coupling flexible links 257, 259 bend or flex with the motion to accommodate any angular and lateral movement of the piston 201 and allow it to move vertically up in direction I guided by the guide walls 209 and/or diaphragm 213 rather than move upward in an arc as it would otherwise tend to do with the lever arrangement.

Referring to FIGS. 12, 13*a*, 13*b* and 14, a second preferred embodiment of the lever-based drive system for a pressure wave generator, generally identified by 300, will now be described. Some of the components of the pressure wave generator 300 are similar to that shown and described in respect of the first preferred embodiment of the lever-based drive system.

Figure 12:
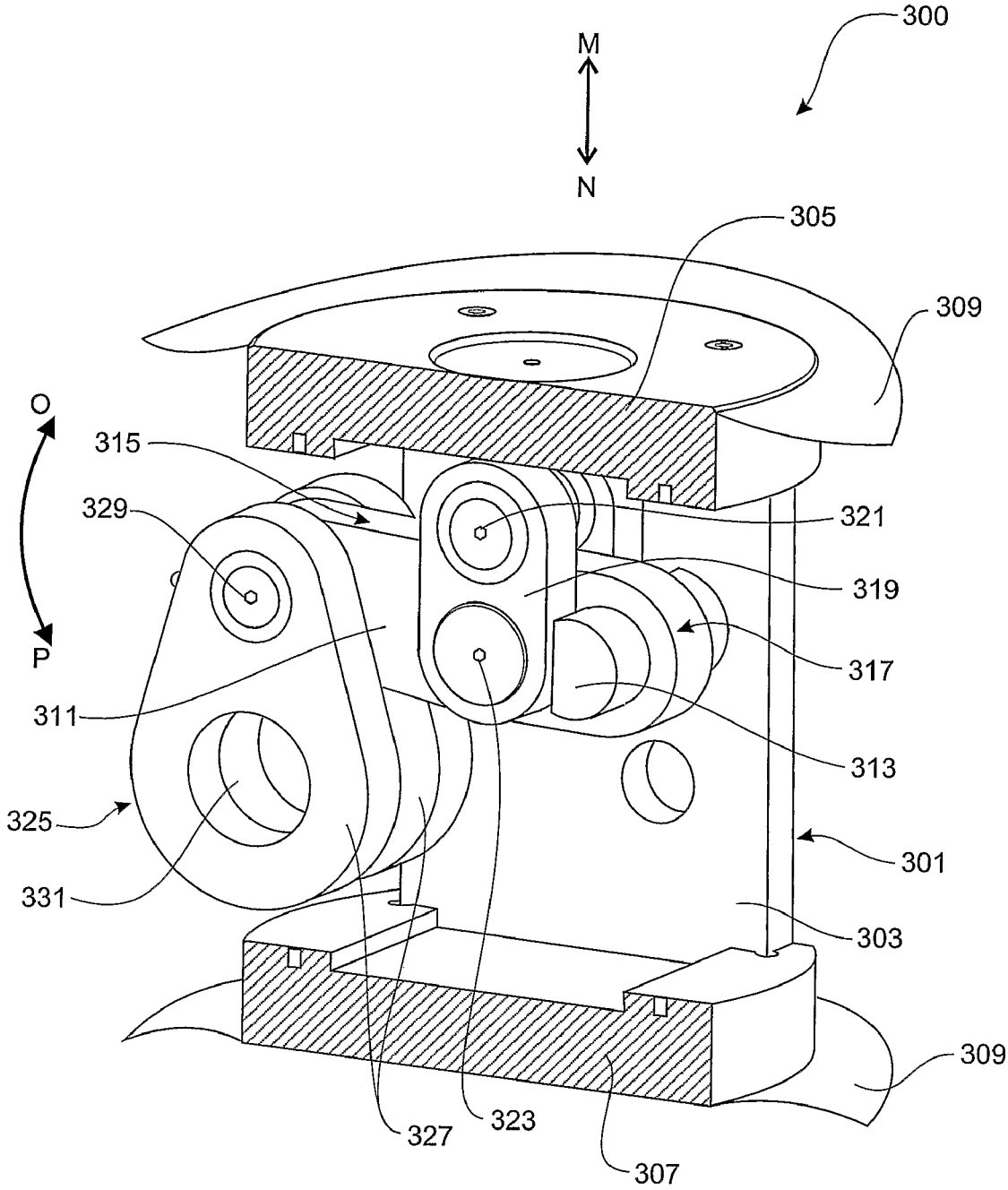
FIG. 12 shows a perspective view of a pressure wave generator that is driven by a drive system that utilises a pivotable coupling to create a pivot point for a reciprocating lever.

Referring to FIG. 12, the pressure wave generator 300 comprises a housing with one or more inlet/outlet ports through which generated pressure waves may pass to drive a connected cryogenic refrigerator system or systems. All components of the pressure wave generator 300 are mounted within the housing, although this is not shown.

The operable drive system of the pressure wave generator 300 comprises a piston 301 having a central member 303 with attached or integral top 305 and bottom 307 end plates. Both the top 305 and bottom 307 plates are coupled to inner edges of annular diaphragms 309 that are each associated with an inlet/outlet port of the housing. The outer edges of the diaphragms 309 are anchored to the housing or fixed supports or mountings within the housing that are not shown. The piston 301 is arranged to reciprocate up and down in a vertical path indicated by arrows M and N to thereby cause a corresponding reciprocating movement of the diaphragms 309 to create reciprocating pressure waves.

The drive system also comprises a lever 311 with first 315 and second 317 ends that is arranged to pivot about a pivotable coupling 313 or fulcrum that is fixed to or within the housing, for example to a stationary machine frame (not shown), to drive the piston 301 and diaphragms 309. By way of example, the pivotable coupling 313 may be a pin joint with a bearing surface that extends through a complementary aperture provided toward the second end 317 of the lever 311. The first end 315 of the lever 311 is arranged to move in a reciprocating arc as indicated by arrows O and P about the pivot point or fulcrum 313.

The lever 311 is coupled to the central member 303 of the piston 301 via a rigid connecting component or link 319. In particular, the connecting component 319 is pivotably coupled at one end to a portion of the central member 303 of the piston 301 via a pivotable coupling component 321, such as a pivot pin/joint or the like. The other end of the connecting component 319 is pivotably coupled to the lever 311 via a pivotable coupling component 323, such as a pivot pin/joint or the like.

In operation, the first end 315 of the lever 311 is moved by an actuator 325 in a reciprocating arc as indicated by arrows O and P. In the preferred form, the actuator 325 is a crank shaft and conrod arrangement that has an associated control system and is similar to that described in respect of the first preferred embodiment. In particular, there are two connecting members 327 that are pivotably coupled at 329 to either side of the first end 315 of the lever 311. The connecting members 327 are moved in a reciprocating motion by a rotatable crank shaft that has integral cranks or eccentrically mounted cranks that rotate in apertures 331 of the connecting members 327 to convert rotational motion into reciprocating motion.

Figure 13A:
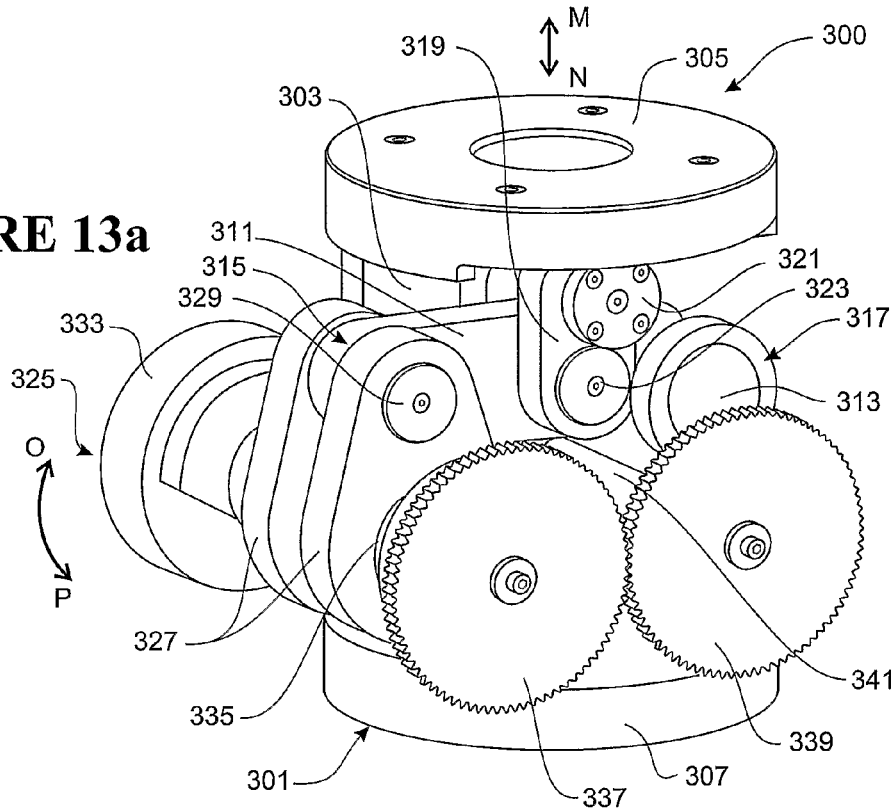
FIGS. 13*a* and 13*b* show perspective views of drive system components of the pressure wave generator of FIG. 12 in operation.
Figure 13B:
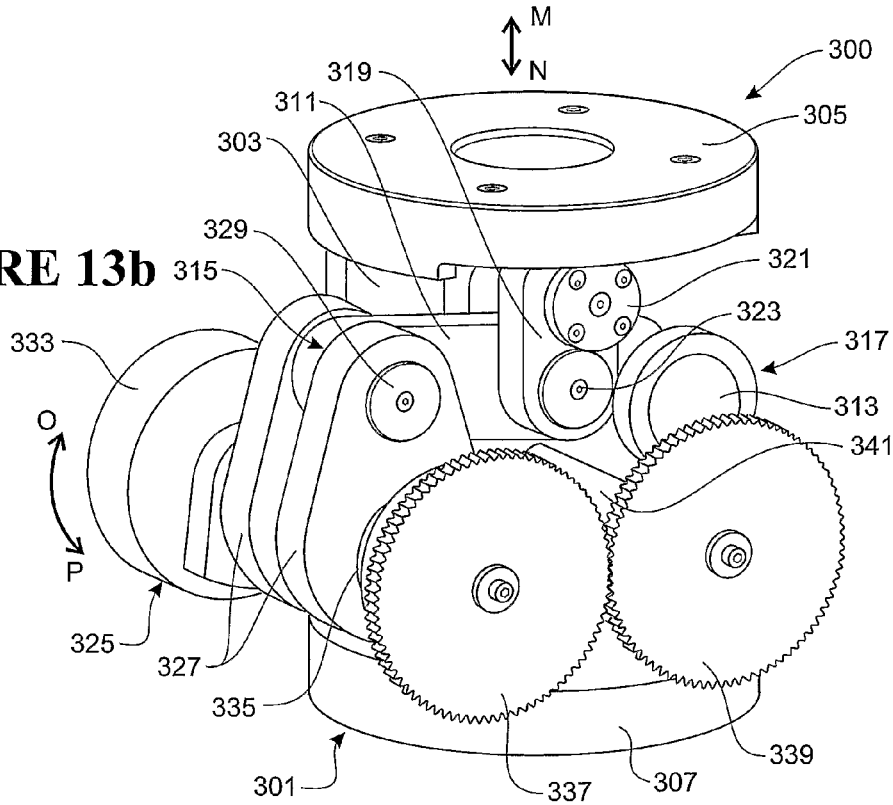

Referring to FIGS. 13*a* and 13*b*, operation of pressure wave generator 300 will be described by way of example. For clarity, some of the components of the pressure wave generator 300 have been omitted, while others have been introduced into the figures. In particular, the diaphragms 309 have been omitted, and more detail of the drive system components has been incorporated into the figures. For example, a flywheel 325 is shown along with the rotatable crank shaft 335 that protrudes through an aperture in the connecting members 327. The drive shaft of a motor protrudes into the flywheel and the flywheel is also coupled to the crank shaft. In operation, the flywheel captures the expansion energy and returns it for compression in the next cycle/oscillation. As previously described, the crank shaft engages, or is integral with, eccentric cranks that rotate within apertures 331 of the connection members 327 to thereby create a reciprocating motion. A toothed wheel 337 is provided toward the end of the crank shaft 335 and this rotates with the crank shaft. A second toothed wheel 339 engages the first wheel 337 and has an associated rotatable shaft for providing dynamic balance of the reciprocating masses via counter-rotating balance shafts.

In the preferred form, each rotation of the drive shaft 335 causes an oscillation of the piston 301 up and down along the path identified by arrows M and N. FIG. 13*a* shows the beginning of an oscillation as the lever 311 is in a rest or intermediate position in the middle of its reciprocating arc (shown generally by arrows O and P). As the drive shaft rotates, the connection members 327 move in a reciprocating motion up and down to cause the lever 311 to move the piston 301 and diaphragm 309 up and down to generate a pressure wave. FIG. 13*b* shows the lever 311 at the top of its reciprocating arc toward arrow O and this causes the piston 301 to move to the top of its reciprocating path at arrow M. As the drive shaft 335 continues to rotate the lever 311 is then moved back down in an arc towards P thereby forcing the piston to follow downward to arrow N. This process continues for each oscillation to generate reciprocating pressure waves.

As with the first preferred embodiment, the second preferred embodiment of the lever-based drive system utilises the lever arrangement to reduce wear and tear on the moving parts. In particular, the pressure wave generated by the diaphragm 309 represents a considerable force that is created by a forceful movement over small distance. The actuator 325 utilises the mechanical advantage of the lever 311 to create the required large force over a small displacement. In particular, the drive shaft and conrod arrangement creates a small force over a large distance at the free end 315 of the lever 311 which is then transferred into a large force over a small distance at the rigid link 319 that couples the lever to the piston 301. This means that the bearings of the conrod and crank shaft arrangement do not need to be as large compared to an arrangement where the conrod is directly coupled to the piston. In particular, the conrod and crank shaft arrangement can utilise bearings that are smaller compared to those required for a directly coupled arrangement that does not utilise a lever. This reduces bearing friction and increases mechanical efficiency. The only moving parts where the load is highest are the pivots on link 319. Therefore, the moving parts where the load is highest and the movement is small are limited, therefore increasing efficiency.

Figure 14:
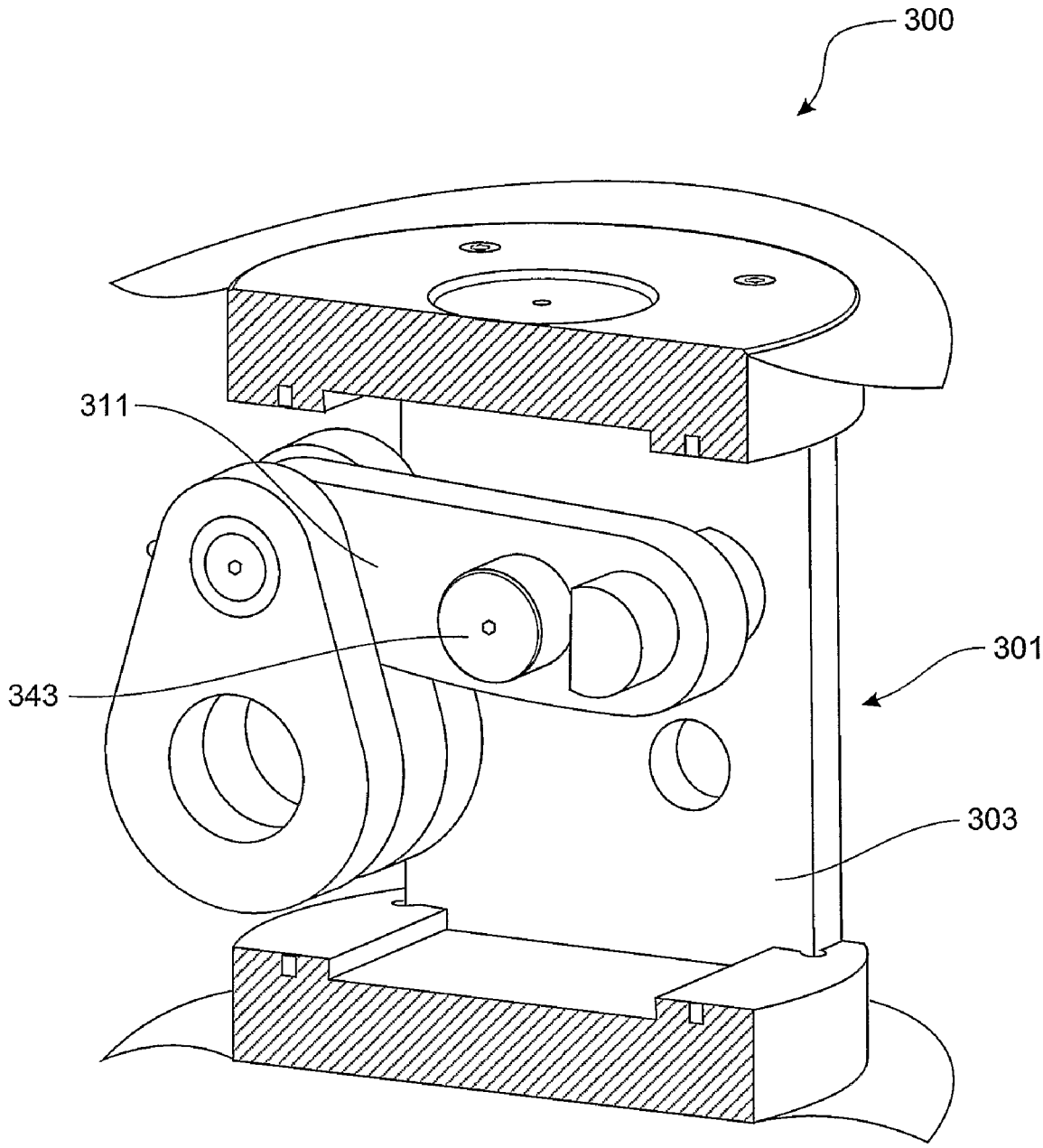
FIG. 14 shows a perspective view of a modified version of the pressure wave generator of FIG. 12 in which there is no connecting link between the lever and piston of the drive system.

FIG. 14 shows an alternative form of the second preferred embodiment of the lever-based drive system in which no rigid link 319 is present in the pressure wave generator 300. In particular, the lever 311 is directly coupled to the central member 303 of the piston 301 via coupling component 343, which may be a pivot pin or a rigid fastening component.

It will be appreciated that the lever-based drive system of either of the first or second embodiments could be arranged to operate a pressure wave generator without a diaphragm in alternative forms. For example, the pistons could reciprocate in cylinders to create the pressure waves.

Benefits and Advantages of the Pressure Wave Generator

The pressure wave generator of the invention is able to produce the required pressure waves to drive Stirling, pulse tube, and other cryogenic refrigerator systems using a low cost diaphragm in an efficient and cost effective manner. The diaphragm may be able to absorb the heat of compression in the compression space hence providing near isothermal compression and hence increasing the efficiency of the cryogenic cooler. The diaphragm separates the clean gas environment required by the cryogenic cooler systems from the driving system allowing the use of cheaper driving components, such as standard rotary motor and crank mechanisms.

The large gas forces on the diaphragm can be balanced by an equal opposing diaphragm which can be used as a gas spring or part of another cryogenic cooler. In particular, each pair of opposed reciprocating diaphragms are arranged in such a manner that the average gas forces are balanced so that the driving mechanism of the drive system only experiences the magnitude of the pressure wave.

Four diaphragms so connected in a square pattern can achieve dynamic balance of the reciprocating masses without extra balance shafts and weights. The diaphragm can be driven by a linear motor in resonance such as a variable gap reluctance motor or reluctance centring motor. Two or more Stirling gas cycles can be driven using pairs of diaphragms in a square four diaphragm arrangement. Further, the pressure wave generator can be used for sealing and guiding expansion pistons or displacers in a Stirling refrigerator.

It will be appreciated that the pressure wave generator of the invention may be utilised in non-cryogenic refrigerator systems, such as conventional domestic refrigerators. Further, the pressure wave generator may be employed for other non-refrigerator applications where reciprocating pressure waves are required.

The foregoing description of the invention includes preferred forms thereof. Modifications may be made thereto without departing from the scope of the invention as defined by the accompanying claims.

The invention claimed is:

1. A pressure wave generator configured to generate reciprocating pressure waves of operating gas for driving one or more cryogenic refrigerator systems, comprising:

a housing with one or more inlet/outlet ports which the generated reciprocating pressure waves of operating gas pass through to drive a cryogenic refrigerator system or systems connected to the inlet/outlet port(s);

at least one pair of opposed diaphragms located in the housing that are moveable in a reciprocating motion within the housing, each diaphragm comprising a front driving side and a rear side and wherein the diaphragms of each pair of opposed diaphragms are secured between the housing and at or toward a respective end of a reciprocating drive part such that the opposed diaphragms are operatively coupled together so that they move together;

a gas space associated with each diaphragm and wherein the front driving side of each diaphragm is arranged to move in a reciprocating motion within its respective gas space to generate reciprocating pressure waves and wherein at least one of the gas spaces has an associated inlet/outlet port of the housing through which the generated pressure waves pass, the gas spaces associated with each pair of diaphragms being connected by a connection pipe comprising an orifice configured to reduce gas flow between the two gas spaces to levels that are sufficient to balance the average gas forces on the opposed diaphragms; and a drive system comprising one or more operable actuators that are arranged to drive the reciprocating drive part in a reciprocating motion to move each pair of diaphragms in a reciprocating motion back and forth in a straight path within the housing to generate the reciprocating pressure waves for driving one or more cryogenic refrigerator systems connected to the inlet/outlet port(s) of the housing, and wherein a common chamber within the housing separate to the gas spaces is defined between the rear sides of the diaphragms within which the reciprocating part(s) of the drive system move and such that the rear sides of the diaphragms move within the same common chamber, and wherein the actuator(s) of the drive system are not located in the gas spaces of the housing.

2. A pressure wave generator according to claim 1 wherein the drive system is arranged to move each pair of diaphragms so that there is a phase difference between the pressure waves generated by each diaphragm in each gas space.

3. A pressure wave generator according to claim 1 wherein the diaphragms of each pair are moved together by the drive system in a reciprocating motion so that the pressure waves generated by one diaphragm of the pair are 180 degrees out of phase with the pressure waves generated by the other diaphragm of the pair.

4. A pressure wave generator according to claim 1 wherein there are two pairs of opposed diaphragms located in the housing, the pairs being substantially orthogonal to each other such that the pressure waves generated by the diaphragms of one pair are 90° out of phase with those generated by the diaphragms of the other pair.

5. A pressure wave generator according to claim 1 wherein the reciprocating drive part associated with each pair of opposed diaphragms is a reciprocating piston.

6. A pressure wave generator according to claim 5 wherein the pairs of diaphragms are annular, with the inner edges of each pair of diaphragms being fixed to opposed ends of a respective piston and the outer edges being fixed at opposing locations within the housing.

7. A pressure wave generator according to claim 6 wherein the actuator(s) of the drive system are directly coupled to the piston(s) of the drive system.

8. A pressure wave generator according to claim 7 wherein the actuator of the drive system comprises a single rotatable crank shaft that has a crank and reciprocating conrod for each piston, the conrod(s) of the actuator being directly coupled to their respective piston(s).

9. A pressure wave generator according to claim 8 wherein there are two pairs of opposed diaphragms located in the housing, the pairs being substantially orthogonal to each other, and the crank of the crank shaft for one pair of diaphragms leads the other crank of the crank shaft for the other pair of diaphragms by 90 degrees.

10. A pressure wave generator according to claim 6 wherein the actuator(s) of the drive system are indirectly coupled to the piston(s) of the drive system via a pivotable lever or levers.

11. A pressure wave generator according to claim 10 wherein each piston of the drive system is coupled to a pivotable lever, and an actuator is coupled to an end of the lever and is arranged to pivot the lever in a reciprocating arc about its pivot point to thereby drive the piston and its pair of diaphragms in a reciprocating motion to generate pressure waves.

12. A pressure wave generator according to claim 11 wherein each lever is fixed at one end to an arrangement of flexible linkages mounted within the housing that are configured to flex between respective rest states and bent states to thereby create a pivot point at the end of the lever about which the lever may pivot, and wherein the flexible linkages flex between their rest and bent states in response to force applied to the free end of the lever thereby allowing the lever to pivot about the pivot point.

13. A pressure wave generator according to claim 11 wherein each lever is coupled to a piston via one or more flexible linkages that extend between a part of the lever and a part of the piston.

14. A pressure wave generator according to claim 11 wherein each lever is coupled at one end to a mounting component fixed within the housing via a pivotable coupling about which the lever may pivot, and wherein each lever is coupled to a piston via a rigid linkage that extends between a part of the lever and a part of the piston.

15. A pressure wave generator according to claim 11 wherein the actuator comprises a conrod that is coupled between an end of the lever and a crank of a rotatable crank shaft such that when the crank shaft rotates it causes the conrod to move in a reciprocating motion thereby driving the end of the lever in a reciprocating arc.

16. A pressure wave generator according to claim 1 wherein each gas space is defined by a diaphragm, a surface of the associated reciprocating drive part of the drive system for the diaphragm, and part of the housing, and wherein the components that define the gas space are formed from material that is suitable for heat exchanging.

17. A pressure wave generator according to claim 1 wherein the inlet/outlet port(s) are connected to any one or more of the following cryogenic refrigerator systems: Stirling, pulse tube, and/or Gifford McMahon systems.

18. A cryogenic refrigerator system comprising a pressure wave generator according to claim 1 that is configured to drive the cryogenic refrigerator system with reciprocating pressure waves of operating gas.

* * * * *